US010236643B2

(12) United States Patent
Nelson et al.

(10) Patent No.: US 10,236,643 B2
(45) Date of Patent: Mar. 19, 2019

(54) ELECTRICAL HUB FOR FURNITURE ASSEMBLIES

(71) Applicant: Sac Acquisition LLC, Stamford, CT (US)

(72) Inventors: Shawn Nelson, Darien, CT (US); David Underwood, Norwalk, CT (US); Brian Kuchler, Stamford, CT (US); David M. Cowan, Cornwall Bridge, CT (US)

(73) Assignee: THE LOVESAC COMPANY, Stamford, CT (US)

( * ) Notice: Subject to any disclaimer, the term of this patent is extended or adjusted under 35 U.S.C. 154(b) by 0 days.

(21) Appl. No.: 15/270,339

(22) Filed: Sep. 20, 2016

(65) Prior Publication Data

US 2017/0149181 A1 May 25, 2017

Related U.S. Application Data

(60) Provisional application No. 62/257,623, filed on Nov. 19, 2015.

(51) Int. Cl.
*H01R 25/00* (2006.01)
*H01R 13/73* (2006.01)
(Continued)

(52) U.S. Cl.
CPC ..... *H01R 13/73* (2013.01); *A47C 21/003* (2013.01); *H01R 25/006* (2013.01); *A47B 2021/066* (2013.01)

(58) Field of Classification Search
CPC ..... H01R 13/73; H01R 25/006
See application file for complete search history.

(56) References Cited

U.S. PATENT DOCUMENTS 988,059 A 3/1911 Allen
2,625,983 A 1/1953 Slyter et al.
(Continued)

FOREIGN PATENT DOCUMENTS

CN 2236262 Y 10/1996
CN 201341645 Y 11/2009
(Continued)

OTHER PUBLICATIONS

Curry, M. "Its Speakers Sound Good Even in Terrible Listening Environments, i.e. Your Apartment;" Core77; Article [online] Sep. 29, 2015 [retrieved Jan. 30, 2017]. Retrieved from the Internet: <URL: http://www.core77.com/posts/41080/Sonos-Debuts-Software-That-Makes-Its-Speakers-Sound-Good-Even-in-Terrible-Listening-Environments-ie-Your-Apartment; p. 2, paragraph 2 to p. 4, paragraph 1.

(Continued)

*Primary Examiner* — William H. Mayo, III
*Assistant Examiner* — Hiram E Gonzalez
(74) *Attorney, Agent, or Firm* — Workman Nydegger

(57) ABSTRACT

An electrical furniture assembly has: (i) a furniture assembly comprising: (A) a base, (B) a transverse member, and (C) a coupler for coupling the base to the transverse member; and (ii) an electrical hub configured to selectively reside within the furniture assembly. The electrical hub features: (A) an electrical outlet assembly; (B) a securement panel; and (C) a spring-biased installation clip. The electrical hub is selectively secured at least partially within a transverse member of a furniture assembly and may be plugged into an external power source to supply power to various electronic devices conveniently used by a user sitting on the furniture assembly.

31 Claims, 17 Drawing Sheets

(51) Int. Cl.
*A47C 21/00* (2006.01)
*A47B 21/06* (2006.01)

(56) References Cited

U.S. PATENT DOCUMENTS 2,653,648 A 9/1953 Marshall
3,113,633 A 12/1963 Eberhardt et al.
3,870,297 A 3/1975 Elder
3,893,731 A 7/1975 Maggs
4,124,249 A 11/1978 Abbeloos
4,321,717 A 3/1982 Serra
4,846,525 A 7/1989 Manning
5,106,153 A 4/1992 Durling
5,362,296 A 11/1994 Wang et al.
5,368,359 A 11/1994 Eakin
5,544,938 A 8/1996 Saul et al.
5,624,156 A 4/1997 Leal et al.
5,681,179 A 10/1997 Lane
5,683,139 A 11/1997 Golynsky et al.
5,735,573 A 4/1998 Vredevoogd
5,790,993 A 8/1998 Roma et al.
5,828,766 A 10/1998 Gallo
5,895,365 A 4/1999 Tomlinson
5,967,820 A 10/1999 Siegal et al.
5,995,634 A 11/1999 Zwolski
6,000,353 A 12/1999 De Leu
6,000,758 A 12/1999 Schaffner et al.
6,073,723 A 6/2000 Gallo
6,092,867 A 7/2000 Miller
6,322,146 B1 11/2001 Fisher, Jr.
6,814,709 B2 11/2004 Schwartz et al.
7,090,297 B2 8/2006 Mohn et al.
7,172,196 B2 2/2007 Randall
7,213,885 B2 5/2007 White et al.
D547,087 S 7/2007 Natuzzi
7,312,393 B2 12/2007 McCarthy
7,419,220 B2 9/2008 White et al.
7,421,608 B2 9/2008 Schron
7,547,073 B2 6/2009 White et al.
7,553,288 B2 6/2009 Cohen
7,575,279 B2 8/2009 Robertson
7,631,937 B2 12/2009 Robertson
7,699,389 B2 4/2010 Robertson
7,735,912 B2 6/2010 Robertson
7,766,421 B2 8/2010 Lawson
7,871,280 B2 * 1/2011 Henriott ..... A47B 21/06 108/50.02
7,918,308 B2 4/2011 Cohen
7,963,612 B2 6/2011 Nelson et al.
7,982,436 B2 7/2011 Randall
8,061,864 B2 11/2011 Metcalf et al.
8,074,581 B2 12/2011 Epstein et al.
8,132,856 B2 3/2012 Wilson et al.
8,146,229 B2 4/2012 Henriott et al.
8,228,026 B2 7/2012 Johnson et al.
8,421,407 B2 4/2013 Johnson
8,668,045 B2 3/2014 Cohen
8,783,778 B2 7/2014 Nelson et al.
8,920,191 B2 12/2014 Carpanzano
8,935,985 B2 1/2015 Hjelm
9,010,851 B2 4/2015 LaPointe
9,088,117 B2 * 7/2015 Rosenblum ..... H01R 25/006
9,095,209 B2 8/2015 Mirth et al.
9,119,000 B2 8/2015 Tracy
9,124,308 B2 9/2015 Metcalf
9,185,988 B1 11/2015 Sanchez
9,277,826 B2 3/2016 Nelson et al.
9,585,468 B2 * 3/2017 Udagawa ..... H02G 3/0487
9,788,092 B2 10/2017 Rawls-Meehan et al.
9,984,686 B1 5/2018 Mutagi et al.
2001/0020810 A1 9/2001 Kennedy
2002/0063454 A1 5/2002 Illulian
2003/0025366 A1 2/2003 Barreiro, Jr.
2003/0139693 A1 7/2003 Swift
2004/0026998 A1 2/2004 Henriott et al.
2004/0061943 A1 4/2004 Bosch et al.
2005/0053252 A1 3/2005 Cohen
2005/0096098 A1 5/2005 Woods
2005/0185801 A1 8/2005 McCarty et al.
2005/0264044 A1 12/2005 Lee
2006/0036201 A1 2/2006 Cohen
2006/0076813 A1 4/2006 Mohn et al.
2006/0238087 A1 10/2006 Holt
2006/0279124 A1 12/2006 White et al.
2007/0164178 A1 * 7/2007 Beilstein ..... H01R 13/745 248/200
2008/0012404 A1 1/2008 Dewed
2008/0150329 A1 6/2008 Lawson
2008/0220646 A1 9/2008 Leddusire
2008/0262657 A1 10/2008 Howell et al.
2009/0032660 A1 2/2009 Wadsworth et al.
2009/0072782 A1 3/2009 Randall
2009/0096255 A1 4/2009 Robertson
2009/0212638 A1 8/2009 Johnson
2009/0212639 A1 8/2009 Johnson
2009/0212737 A1 8/2009 Johnson et al.
2009/0250982 A1 10/2009 Cohen
2010/0178797 A1 * 7/2010 Byrne ..... H01R 25/006 439/540.1
2010/0290215 A1 11/2010 Metcalf et al.
2010/0320819 A1 12/2010 Cohen et al.
2011/0012403 A1 1/2011 Wilson et al.
2011/0109211 A1 5/2011 Kirkeby et al.
2011/0110075 A1 5/2011 Smith
2011/0298340 A1 12/2011 Nelson et al.
2012/0026724 A1 2/2012 Metcalf et al.
2012/0051579 A1 3/2012 Cohen
2012/0200129 A1 8/2012 Wilson, Jr.
2012/0286557 A1 11/2012 Hoffman et al.
2013/0199421 A1 8/2013 Hjelm
2013/0207478 A1 * 8/2013 Metcalf ..... A47C 7/70 307/104
2013/0234481 A1 9/2013 Johnson
2013/0249257 A1 9/2013 Suhre et al.
2013/0333940 A1 * 12/2013 Stencil ..... H02G 3/18 174/503
2014/0010387 A1 1/2014 Cohen
2014/0197666 A1 7/2014 Koch
2014/0285140 A1 9/2014 Jung
2014/0368476 A1 12/2014 Rauch et al.
2015/0069965 A1 3/2015 Verschueren
2015/0076881 A1 3/2015 LaPointe et al.
2015/0076891 A1 3/2015 LaPointe et al.
2015/0255914 A1 9/2015 Kong et al.
2015/0300627 A1 10/2015 Wang et al.
2016/0136529 A1 5/2016 Weston et al.
2016/0174715 A1 6/2016 Nelson et al.
2016/0379631 A1 12/2016 Wang et al.
2017/0143122 A1 5/2017 Nelson et al.
2017/0150264 A1 5/2017 Nelson et al.
2017/0214197 A1 7/2017 Suri
2017/0295941 A1 10/2017 King et al.
2018/0000244 A1 1/2018 Nelson et al.
2018/0041354 A1 2/2018 Nelson et al.

FOREIGN PATENT DOCUMENTS

CN 201452358 U 5/2010
CN 20253058 U 11/2012
CN 202907151 U 4/2013
CN 202981088 U 6/2013
CN 203563950 U 4/2014
CN 203609079 U 5/2014
WO 9963786 12/1999
WO 2009113319 9/2009
WO 2012093398 10/2012
WO 2014072975 5/2014
WO 2017087224 5/2017

(56) References Cited

FOREIGN PATENT DOCUMENTS

| | | |
|---|---|---|
| WO | 2017087266 | 5/2017 |
| WO | 2017087268 | 5/2017 |

OTHER PUBLICATIONS

Notification of Transmittal of the International Search Report and the Written Opinion of the International Searching Authority, or the Declaration, dated Apr. 3, 2017 with Search History (25 pages).
Invitation to Pay Additional Fees and, Where Applicable, Protest Fee, from International Application No. PCT/US16/61491, dated Jan. 24, 2017 (2 pages).
Office Action from United States Application No. 13/869,600, dated Dec. 15, 2015 (9 pages).
The Wall Street Journal newspaper article entitled, "Wireless Charging Everywhere," dated Dec. 30, 2015.
U.S. Appl. No. 60/778,761, entitled Power Delivery Surface Power Supply Safety, filed Mar. 3, 2006 (59 pages).
Notification of Transmittal of the International Search Report and the Written Opinion of the International Searching Authority, or the Declaration, dated Apr. 19, 2017 with Search History (12 pages).
"WISA Wireless Speaker &Audio," retreived on Nov. 7, 2016 at www.wisaassociation.org, 3 pages.
"The Wireless Speaker and Audio (WISA®) Association" retreived Nov. 7, 2016 at www.wisaassocation.org, 2 pages.
Leviton, "Product Bulletin for Recessed Devices Cat. Nos. 689 and 690," Copyright 2008, published and available, on information and belief, at least as early as 2008 (2 pages).
Leviton, "2-Gang White Duplex Outlet/Quick Port Plate Recessed Device," retreived Nov. 17, 2017 at homedepot.com, (2 pages).
U.S. Appl. No. 15/348,068, Nov. 1, 2017, Office Action.
U.S. Appl. No. 15/348,068, Apr. 2, 2018, Final Office Action.
Notification of Transmittal of the International Search Report and the Written Opinion of the International Searching Authority, or the Declaration from PCT/US16/61508, dated Apr. 19, 2017 (12 pages).
Notification of Transmittal of the International Search Report and the Written Opinion of the International Searching Authority, or the Declaration, from PCT/US16/61491 dated Apr. 3, 2017 (25 pages).
U.S. Appl. No. 15/786,922, Nov. 28, 2018, Office Action.
U.S. Appl. No. 15/348,068, Dec. 12, 2018, Notice of Allowance.
U.S. Appl. No. 15/348,068, Oct. 2, 2018, Office Action.

* cited by examiner

ELECTRICAL HUB FOR FURNITURE ASSEMBLIES

PRIORITY CLAIM

This application claims priority to and the benefit of U.S. Provisional Patent Application Ser. No. 62/257,623, filed on Nov. 19, 2015, entitled "Furniture with Electronic Assemblies," which is incorporated herein by reference.

BACKGROUND OF THE INVENTION

1. The Field of the Invention

This invention is in the field of electronic furniture assemblies.

2. The Relevant Technology

Electronics are widely used for business, social activities, entertainment and for practical, commercial, and household uses. When sitting on furniture, it is often desirable to employ one or more electronic assemblies. What are needed are improved electronic assemblies that can be used in association with modern furniture assemblies.

BRIEF SUMMARY OF THE INVENTION

The present invention relates to electronic furniture assemblies and electrical components associated with furniture.

One electronic furniture assembly of the present invention comprises: (i) a furniture assembly comprising: (A) a base (e.g., a seat portion), (B) at least one transverse member (e.g., a side, armrest or backrest), and (C) a coupler for coupling the base to the transverse member; and (ii) an electrical hub configured to selectively reside within the furniture assembly. The electrical hub may be selectively positioned, for example, within a cavity in a transverse member of the furniture assembly.

In one embodiment, the electrical hub comprises: (a) an electrical outlet assembly, the electrical outlet assembly having a housing; (b) a securement panel having a front face and a rear face, wherein the rear face of the securement panel is linked to and offset from the electrical outlet assembly such that at least one outlet of the electrical outlet assembly is spaced away from the securement panel; and (c) an installation clip mounted to the electrical outlet assembly, the installation clip having a compressed position and an extended position. The offset securement panel forms a protective area within which to connect or more electrical cords to the outlet assembly.

The installation clip is configured to be selectively moved with respect to the electrical outlet assembly, the clip being moveable from the extended position to the compressed position in order to mount the electrical hub within the furniture assembly and is further configured to be selectively moved by a user from the extended position to the compressed position in order to remove the electrical hub from the furniture assembly.

In one embodiment, an electrical hub of the present invention may have one or more tabs extending from the securement panel and includes an electrical cord for plugging into a wall outlet, for example. The one or more tabs may extend from and are generally coplanar with the panel.

The electrical hub is configured to be secured at least partially within the cavity of a transverse member of a furniture assembly such that the electrical outlet assembly of the electrical hub is configured to selectively reside substantially within the cavity of the transverse member while the securement panel abuts the surface of transverse member.

The one or more electrical outlets of the electrical outlet assembly may include standard 110-Volt or 220-Volt outlets, for example, and/or USB ports and/or audio jacks and the like. The electrical cord of the hub may include one or more cord outlets, such as internal outlets, floor resting outlets, and/or tether outlets. Electronic devices may be plugged into the cord outlets. Other electrical cords may also be plugged in to the cord outlets of other hub electrical cords. In this way, a system of two or more electrical hubs may be connected in series, each residing in different transverse members of a furniture assembly and connected to a single external power source, such as a wall outlet.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which:

FIG. 17 is a right perspective view of an embodiment of an electrical hub of the present invention. An electrical cord may be attached to the hub of FIG. 17.

FIG. 18 is a left perspective view of the electrical hub of FIG. 17.

FIG. 19 is a front view of the electrical hub of FIG. 17.

FIG. 20 is a right side view of the electrical hub of FIG. 17.

FIG. 21 is a left view of the electrical hub of FIG. 17.

FIG. 22 is a rear view of the electrical hub of FIG. 17.

FIG. 23 is a top view of the electrical hub of FIG. 17.

FIG. 24 is a bottom view of the electrical hub of FIG. 17.

FIG. 25 is a right rear perspective view of the electrical hub of FIG. 17.

FIG. 26 is a left rear view of the electrical hub of FIG. 17.

DETAILED DESCRIPTION OF THE PREFERRED EMBODIMENTS

The present invention relates to electronic assemblies and/or components associated with furniture. An example of a furniture assembly of the present invention is shown in FIG. 1.

Figure 1:
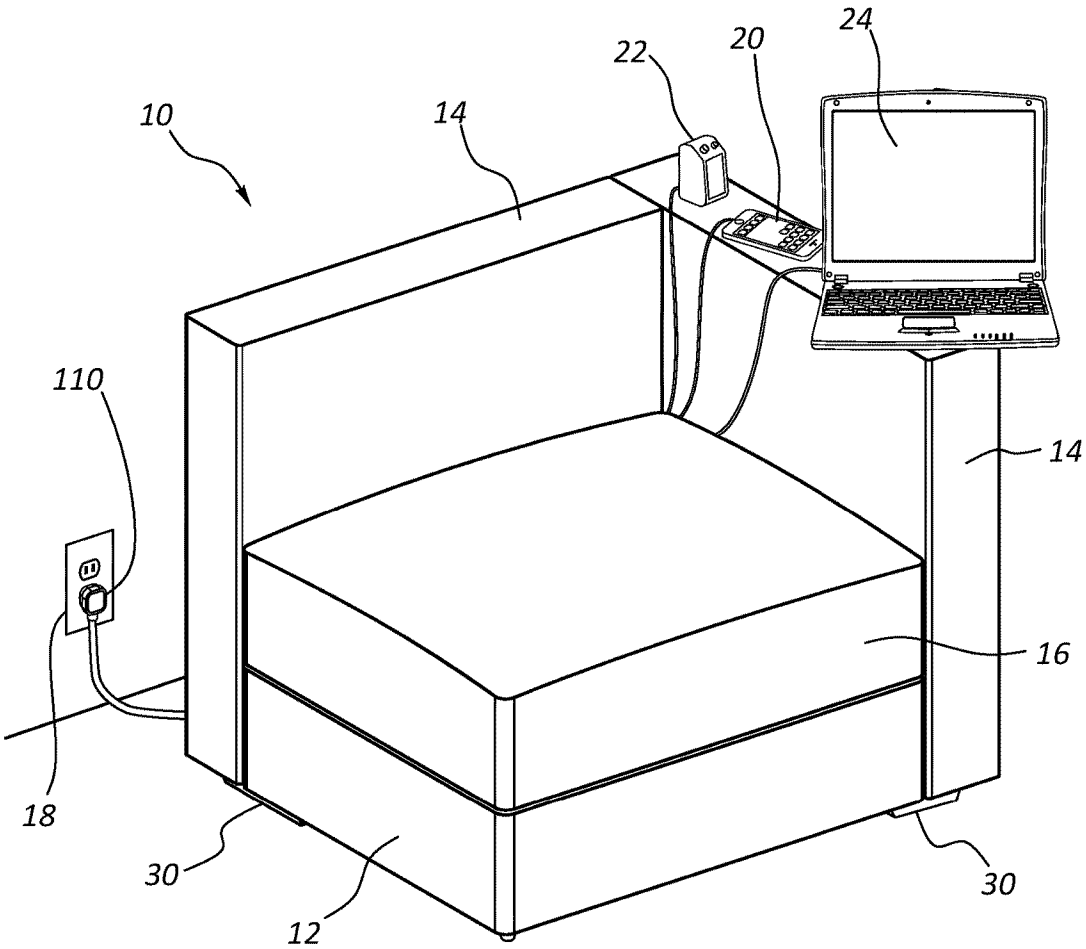
FIG. 1 illustrates a perspective view of an electronic furniture assembly along with various electronic devices (computer, phone, speaker) plugged into an electrical hub mounted within the modular furniture assembly shown. The electrical cord of the electrical hub is shown in FIG. 1.

A furniture assembly 10 of FIG. 1 is comprised of a base 12, first and second transverse members 14, and a cushion 16 which rests on the base 12. Furniture assembly 10 is shown adjacent an electrical outlet 18, as is common in a home or business setting, for example. The use of the electrical hub of the present invention enables furniture assembly 10 to house the electrical hub of the present invention, making it more convenient to plug electrical devices into a power source while sitting on the furniture assembly 10.

For example, as shown in FIG. 1, a plurality of electronic devices 20, 22, 24 are electrically coupled to the furniture assembly 10, which receives electrical power from electrical outlet 18 mounted on the wall adjacent the furniture assembly 10. As shown in FIG. 1, the furniture assembly 10 provides a convenient place both for sitting by a user, as well as for using the user's electronic devices.

Figure 2:
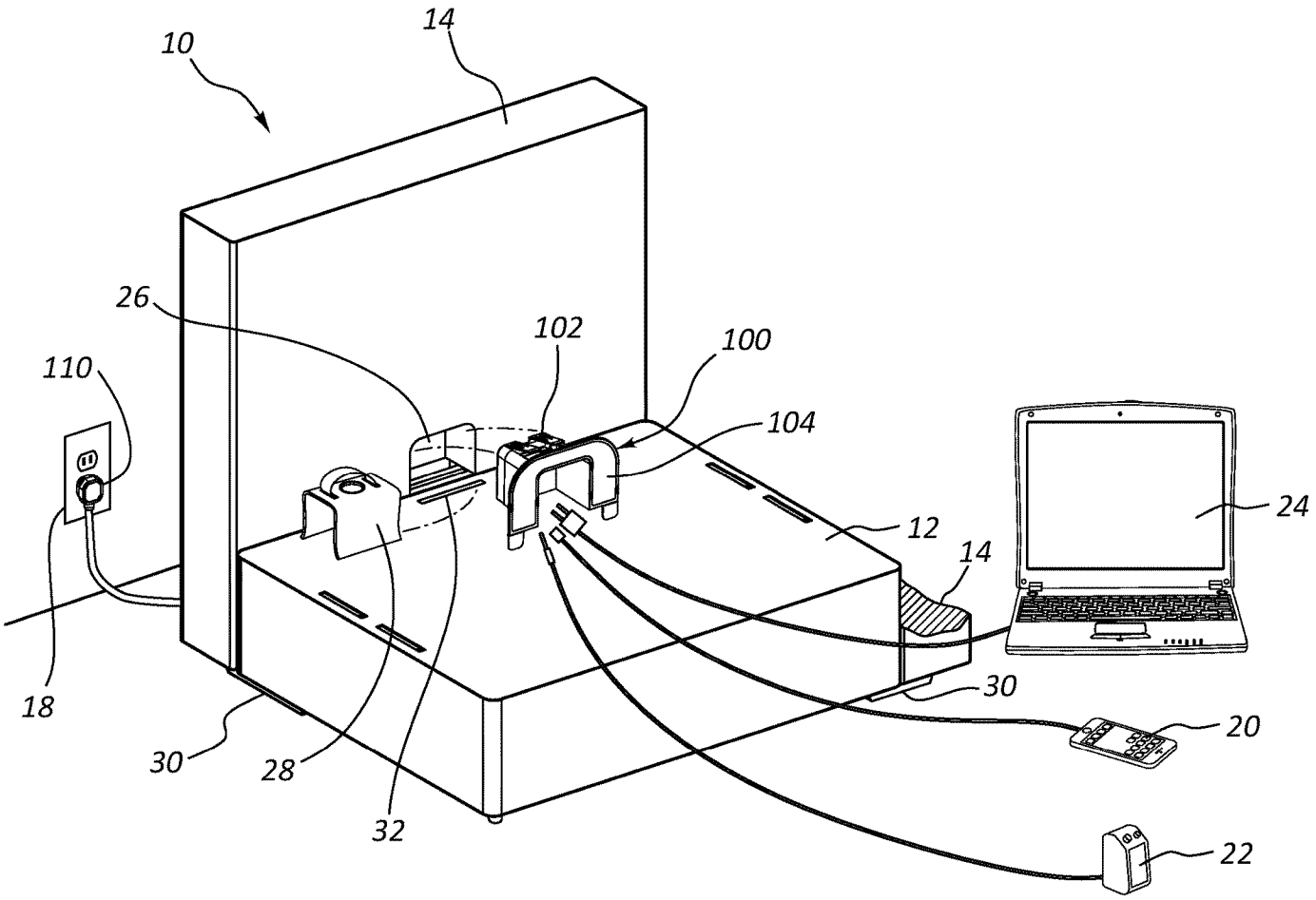
FIG. 2 illustrates an exploded view of the electrical furniture assembly of FIG. 1, showing the electrical hub and other components of the electronic furniture assembly. (A cushion 16 of FIG. 1 is not shown in the exploded view of FIG. 2).

Additional details relating to the furniture assembly 10 are shown in an exploded view in FIG. 2. As shown in FIG. 2, base 12 of furniture assembly 10 is selectively coupled to first and second transverse members 14 of furniture assembly 10, the second transverse member being shown in a partial view in FIG. 2. Each transverse member 14 has a cavity 26 in a middle, lower portion thereof. A U-shaped coupler 28, selectively couples an upper portion of a base 12 to a middle, lower portion of a transverse member 14. Foot couplers 30 selectively couple respective feet of base 12 to respective feet of the transverse members 14. Foot couplers 30 have apertures therein that receive the feet of respective adjacent bases and transverse members, coupling them to each other. In one embodiment, a foot coupler such as coupler 30 can be placed under a foot of a base that is not adjacent a transverse member or other base, for aesthetic continuity and/or to provide a level surface of all four corners of the base. Furniture assembly 10 is a modular furniture assembly that can be assembled as illustrated in FIG. 2, for example.

Figure 10:
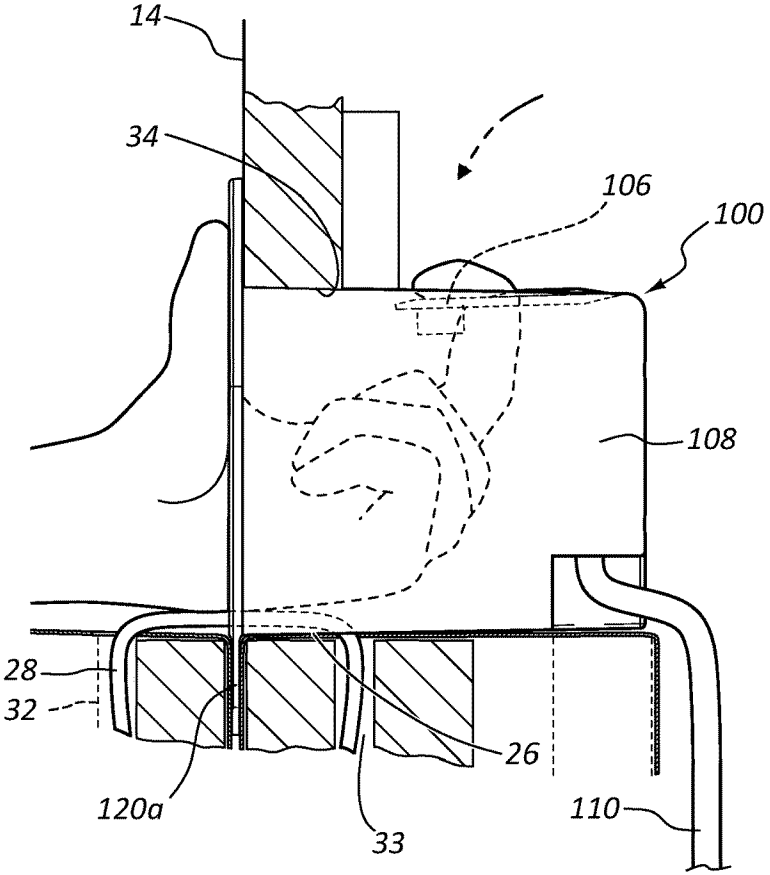
FIGS. 9-10 illustrate views of the electrical hub of FIG. 2, illustrating movement of the clip from the extended position of FIG. 9 to the compressed position of FIG. 10.
Figure 9:
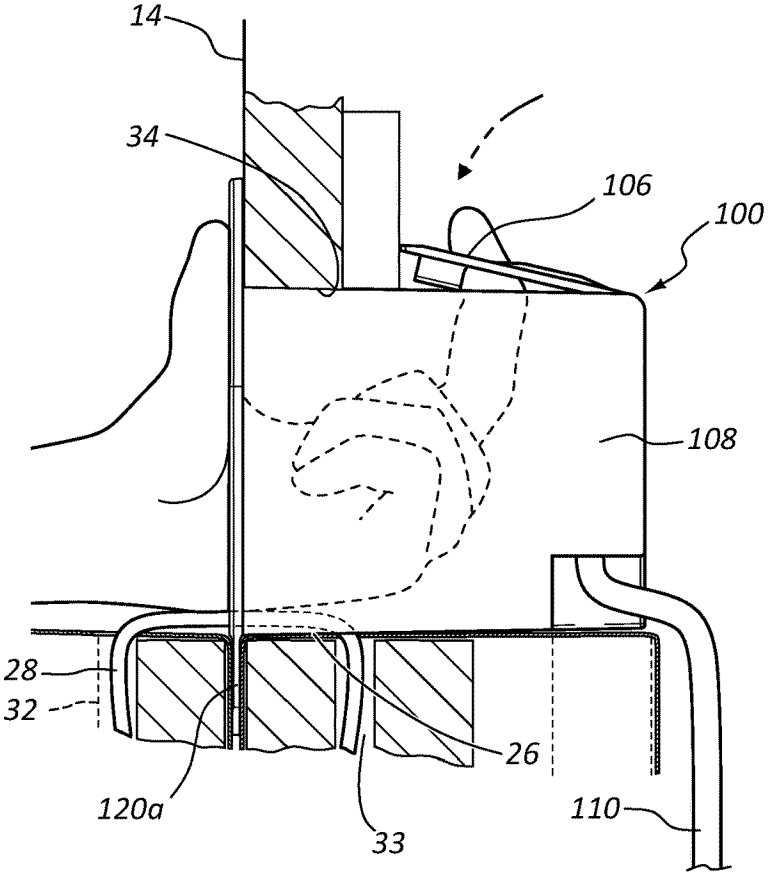

As illustrated in FIG. 2 and FIGS. 9-10, a U-shaped coupler 28 selectively connects a portion of base 12 to a portion of a transverse member 14 by placing one plate of the U-shaped coupler 28 within an aperture 32 in the frame of base 12 and another plate of the U-shaped coupler 28 within an aperture 33 in the frame of transverse member 14 that is in the cavity 26 of transverse member 14, thereby selectively coupling base 12 to transverse member 14. The second transverse member 14, shown in partial view in FIG. 2, and/or additional transverse members 14, can be selectively coupled similarly or in exactly the same manner to base 12.

Base 12 is used as a seat member and/or for receiving a cushion 16 to be used as a seat member while transverse member 14 can be used as a backrest and/or arm rest. Various combinations of bases, transverse members, and U-shaped couplers and foot couplers can be used in varying numbers to create a variety of different furniture assemblies of the present invention, as discussed and illustrated in the patents and patent applications that are incorporated herein by reference.

An electrical hub 100 is also shown in an exploded view in FIG. 2, electrical hub being selectively mounted within the cavity 26 of transverse member 14 and a portion of an electrical hub 100 being selectively sandwiched between a portion of base 12 and a portion of transverse member 14, thereby maintaining hub 100 in a convenient, stable position within furniture assembly 10. Hub 100 acts as a convenient power source for electrical devices 20, 22, 24.

When cushion 16 of FIG. 1 is placed onto base 12 and adjacent transverse member 14, hub 100 is not visible to the user, as shown in FIG. 1, with the exception of the portion of the electrical cord 110 that extends from behind furniture assembly 10 of FIG. 1 and into the electrical outlet 18.

An electronic furniture assembly of the present invention thus comprises: (i) a furniture assembly 10 comprising: (A) a base 12, (B) a transverse member 14, and (C) a coupler 28 for coupling the base 12 to the transverse member 14; and (ii) an electrical hub 100 as shown in FIG. 2 configured to selectively reside within the furniture assembly 10. As shown in FIGS. 1 and 2, electrical hub 100 enables the resulting electronic furniture assembly of FIGS. 1 and 2 to conveniently receive and act as a source of electrical power for personal objects, such as all phones, computers and other accessories used while sitting on the furniture assembly 10.

The electrical hub 100 of the present invention comprises one or more electrical outlets. Hub 100 is configured to be selectively integrated into furniture assembly 10. One or more electrical hubs 100 is configured to be selectively integrated into a variety of other furniture assemblies, having one or multiple transverse members 14, such as the furniture assemblies disclosed in (i) U.S. patent application Ser. No. 14/332,705, filed Jul. 16, 2014, entitled MOUNTING PLATFORM FOR MODULAR FURNITURE ASSEMBLY, (ii) U.S. Pat. No. 8,783,778, entitled MOUNTING PLATFORM FOR MODULAR FURNITURE ASSEMBLY, (iii) U.S. Pat. No. 7,963,612 entitled MODULAR FURNITURE ASSEMBLY, (iv) U.S. patent application Ser. No. 11/449,074, filed Jun. 8, 2006, entitled MODULAR FURNITURE ASSEMBLY, now U.S. Pat. No. 7,547,073, (v) U.S. Pat. No. 7,213,885 entitled MODULAR FURNITURE ASSEMBLY, (vi) U.S. Provisional Application No. 62/354,426 filed Jun. 24, 2016 entitled MODULAR FURNITURE ASSEMBLY CORNER SEATING SYSTEM, and (vii) Provisional Patent Application Ser. No. 62/257,623, filed on Nov. 19, 2015, entitled "Furniture with Electronic Assemblies," each of which are incorporated herein by reference. Various furniture assemblies can be formed using bases, transverse members, couplers to form a couch and/or chair of the present invention, such as disclosed in the aforementioned patents and applications and various numbers of hubs 100 can be used with various of such furniture assemblies. The electrical hubs 100 described herein are compatible to communicate with the transverse member cavities disclosed in the aforementioned patents and applications.

For example, hub 100 can be conveniently used within the transverse members of the furniture assemblies disclosed in U.S. Pat. No. 7,213,885 entitled MODULAR FURNITURE ASSEMBLY, wherein the furniture assemblies have a configuration such that the length X of the base and the length X' of the transverse member are equal to each other and wherein the length X of the base is equal to the width of the base and the width of the transverse member, such that X=Y+Z and X=X' as disclosed in U.S. Pat. No. 7,213,885 entitled MODULAR FURNITURE ASSEMBLY, which is incorporated herein by reference.

The drawings provided herein show hub 100 in use in connection with modular furniture. However, hub 100 is conveniently used in connection with various types of furniture, including: (i) fixed, non-configurable furniture; (ii) furniture that is assembled by a consumer (known as "assemble-able furniture); and furniture that can be configured into a variety of different configurations (known as "modular furniture"). Assembleable furniture includes (i) modular furniture that can be configured into a variety of different configurations and (ii) furniture that can only be assembled into a single configuration. Hub 100 is conveniently used in connection with various types of furniture, including (i) fixed-nonconfigurable, (ii) assembleable-modular and (iii) assembleable-non-modular furniture.

Thus, although FIGS. 1 and 2 illustrate a furniture assembly 10 that includes two transverse members 14, a base member 12, and a cushion 16, in other embodiments, the hub 100 or hubs 100 may be used in other combinations of transverse members 14 and base members 12, such as those disclosed in the aforementioned patents and applications, hub 100 being configured to be disposed partially within at least one of the transverse members 14 of such assemblies. Cushion 16 hides the hub 100 from view. A number of mobile, computing and/or other electronic devices 20, 22, 10*c* are plugged in to the hub 100 that resides at least partially within the transverse member 14 behind the cushion 16.

FIGS. 1 and 2 illustrate a mobile phone 20, a speaker 22, and a laptop computer 24 plugged in to the hub 100. Other electrical devices that may be plugged into the hub 100 may include, but are not limited to, table lamps, induction chargers, couch and/or chair lamps, reading and/or floor lamps, mobile computing devices, speakers, stereo systems, vacuums, heaters, fans, electric blankets, and the like for use by a user using furniture assembly 10.

FIGS. 1 and 2 also illustrate a hub electrical cord 110 plugged into a wall outlet 18. The hub electrical cord 110 provides electrical power to the hub 100, which in turn provides electrical power to the one or more electronic devices 20, 22, 24 that are plugged into the hub 100. In this way, electronic devices 20, 22, 24 are powered via the hub 100 in a visual pleasing and convenient way as shown in FIG. 1. For example, the electrical outlets of hub 100 and connections of the electrical devices to the hub 100 are not seen in use in FIG. 1 and the hub electrical cord 110 provides power to multiple electronic devices 20, 22, 24 from a single a power source. A person sitting on or otherwise using the illustrated furniture assembly 10 has access to his or her electronic devices 20, 22, 24 while they are being powered through the hub 100 without the need for multiple electrical cords or other power strips separate from the furniture assembly 10.

As shown in FIG. 2, and further in FIGS. 3-9 in one embodiment, the electrical hub 100 comprises: (a) an electrical outlet assembly 102; (b) a securement panel 104 having a front face 105*a* and a rear face 105*b*, wherein the rear face 105*b* of the securement panel 104 is linked to the electrical outlet assembly 102, such that at least one outlet of the electrical outlet assembly 102 is spaced away and offset from the securement panel 104; and (c) an installation clip 106 mounted to the electrical outlet assembly 102, the installation clip 106 being moveable with respect to the electrical outlet assembly 102, the installation clip 106 having an extended position (FIG. 9) and a compressed position (FIG. 10). Electrical outlet assembly 102 includes electrical cord 110 and at least one electrical outlet in electrical communication with cord 110.

The free end of the installation clip 106 is movable with respect to assembly and is configured to be normally in the extended position of FIG. 9 absent any other force, and is selectively moved by a user from the extended position to the compressed position of FIG. 10 in order to mount the electrical hub 100 within the furniture assembly 10. Clip 106 is further configured to be selectively moved by a user from the extended position to the compressed position in order to remove the electrical hub 100 from the furniture assembly.

Hub 100 is configured to be selectively mounted within a furniture assembly 100 in order to provide a source of electrical power for one or more electrical devices 20, 22, 24 adjacent the furniture assembly, as illustrated in FIG. 2.

Figure 3:
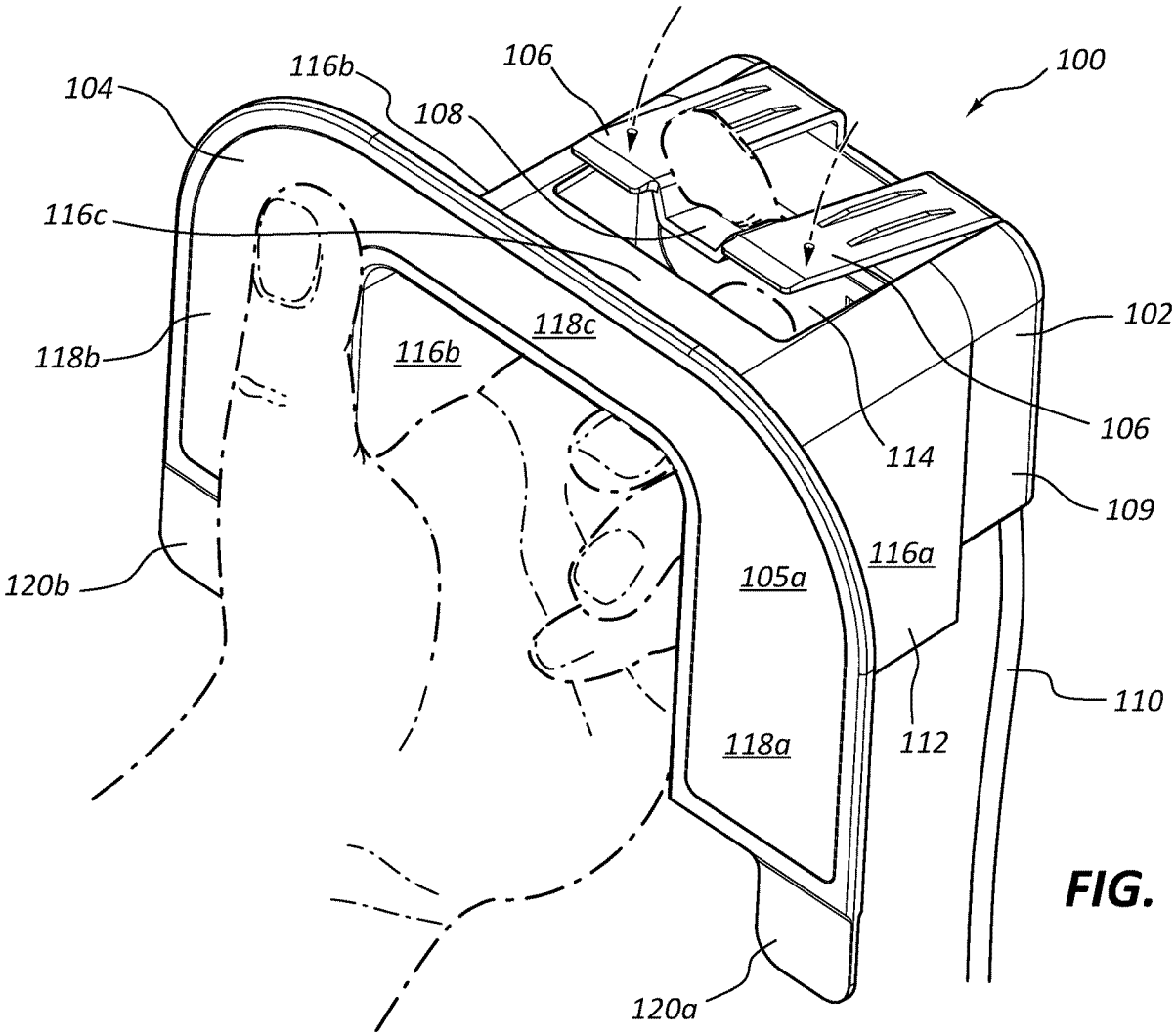
FIG. 3 illustrates a right front, perspective view of the electrical hub of FIG. 2 with a user's hand placed within a cavity of the hub to thereby move a clip of the hub in order to place the hub within a transverse member of the modular furniture assembly. The hub is configured to be selectively mounted within a furniture assembly in order to provide a source of electrical power for one or more electrical devices adjacent the furniture assembly.
Figure 6:
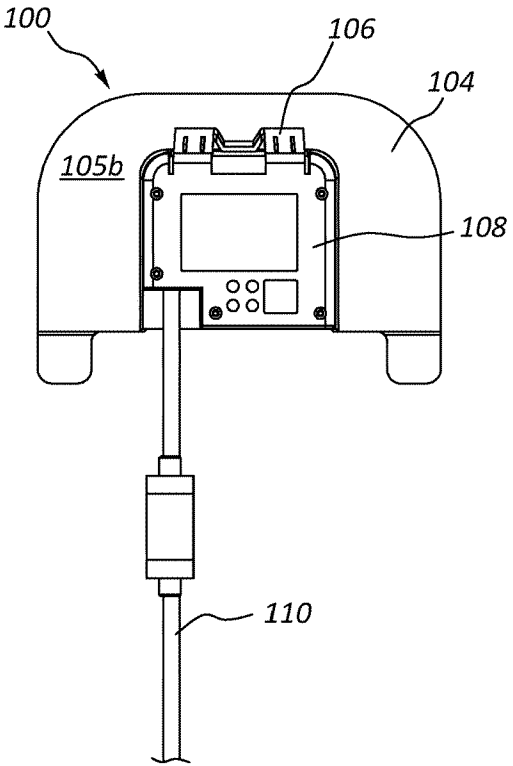
FIG. 6 illustrates a rear view of the electrical hub of FIG. 2.
Figure 5:
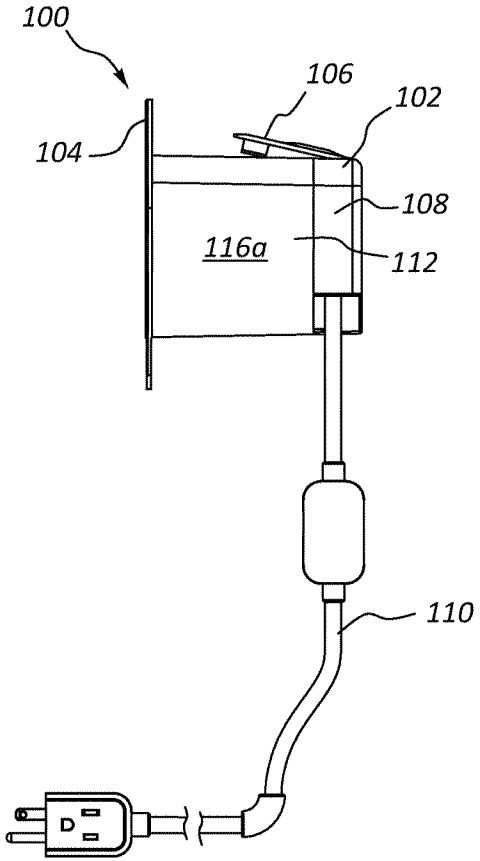
FIG. 5 illustrates a right side view of the electrical hub of FIG. 2.

FIG. 3 illustrates a perspective view of hub 100 with a user's hand ready to manipulate clip 106 downward to facilitate placement or removal of the hub 100 into or from assembly 10. As illustrated, the clip 106 includes a finger hold divot 116*c* configured to aid in grasping the clip 106 with a finger and/or other tool. In other embodiments, a finger hold of the clip of the present invention may take any other form that facilitates grasping the clip in order to apply a force against the spring loaded biasing force of the clip. Other forms may include, but are not limited to, holes, tabs, notches, grooves, and the like, for example.

Assembly 102 has a housing that links assembly 102 to panel 104. Electrical outlet assembly 102 has a housing that is comprised of: (i) a covering housing portion 109 which houses one or more electrical outlets, and from which electrical cord 110 of assembly 102 extends, and (ii) a linkage housing portion 112 which links the covering housing portion 109 to the securement panel 104. Linkage housing portion 112 is a substantially U-shaped member, having an aperture 114 in an upper portion thereof for movement of clip 106 there through. Housing portion 112 comprises a right side panel 116*a*, a left side panel 116*b* and a central panel 116*c* connecting panel 116*a* to 116*b*. Aperture 114 extends through panel 116*b*. Linkage housing portion 112 extends substantially perpendicularly from rear face 105*b* of panel 104 to cover housing portion 109 of electrical outlet assembly 102. Electrical outlet assembly 102 thus comprises at least one electrical outlet, an electrical cord 110 electrically coupled to the at least one outlet, and a housing comprised of a covering housing portion 109 and a linkage housing portion 112.

As further shown in FIGS. 3-8, securement panel 104 is a U-shaped member comprised of a right panel member 118*a*, a left panel member 118*b* and a central panel member 118*c* connecting panel member 118*a* to panel member 118*b*. Panel 104 defines a plane extending through panel members 118*a-c*. Securement panel 104 is linked to and spaced away from the electrical outlet assembly 102 such that at least one outlet of the electrical outlet assembly 102 is offset from the plane of the securement panel 104, which extends through members 118*a-c*. The linkage housing portion 112 of the assembly 102 provides a convenient, protective area within which to plug the cords of the one or more electrical devices.

One or more tabs 120*a-b* extend from the panel 104 of the hub 100 and are configured to reside between the transverse member 14 and the base member 12 when transverse member 14 and base member 12 are coupled together. In this way, the tabs 120*a-b* are press fitted between the transverse and base members 12, 14, so as to help secure the hub 100 at least partially within the cavity 26 in transverse member 14. Other embodiments may include tabs that are larger or smaller than the tabs 120*a-b* illustrated herein. Other embodiments may include tabs that are positioned closer or further away from each other. The illustrated embodiment illustrates tabs 120*a-b* that are generally rectangular and/or square in shape. Other embodiments may include tabs that are other shapes, including, but not limited to, triangles, semi-circles and/or otherwise curvilinear shapes, or combination thereof, and the like.

FIG. 2 illustrates an exploded view for purposes of understanding the invention. In one embodiment, during assembly, transverse member 14 and base 10 are not coupled to each other by coupler 28 when hub 100 is placed into cavity 26. In one such embodiment, transverse member 14 and base 12 are provided. Hub 100 is then selectively mounted within cavity 26 of transverse member 14 and base 12 is moved adjacent transverse member 14 with tabs 120*a-b* of hub 100 between base 12 and transverse member 14. Base 12 is then coupled to transverse member 14 by placing coupler 28 within apertures 32 and 33 of base 12 and transverse member 14, respectively.

Thus, another advantage of the cavity 130 of hub 100 is that cavity 130 conveniently allows the placement of coupler 28 into base 12 and member 14. As shown, a method for providing electrical power to a furniture assembly thus comprises: (i) providing a transverse member 14; (ii) providing a base 12; and (iii) selectively mounting a portion of an electrical hub 100 within a cavity of one of: (A) the base; and (A) the transverse member. In yet another embodiment, a portion of hub 100 is selectively mounted with a cavity in the base of the furniture assembly.

With continued reference to FIGS. 3-8, panel 104 is generally planar. Tabs 120*a-b* extend from panel 104 and are generally coplanar with panel 104. Panel 104 and/or one or more tabs 120*a-b* are configured to reside generally flush with and on an outside surface of a transverse member 14 of a furniture assembly while electricaly outlet assembly 102 is mounted with the cavity of transverse member 14. Panel 104 prevents hub 100 from being inserted too far into transverse member 14. The panel 104 and one or more tabs 120*a-b* may be made of various rigid and/or semi-rigid materials, such as, but not limited to, plastics, rubbers, natural materials such as wood and/or stone, and the like, for example.

The U-shaped linkage housing portion 112 extends away from U-shaped panel 104, substantially perpendicularly to the plane of the panel 104, thereby defining a cavity 130 within hub 100 in order to facilitate reaching into hub 100 as shown in FIG. 3. When hub 100 is secured at least partially within a transverse member 14, the electrical outlet assembly 102 resides substantially within the transverse member. The housing portions 108, 112 are made of rigid and/or semi-rigid material, such as plastic, preferably made of insulating materials, such as plastic, so as to safely and functionally house electronic outlets and/or circuits.

The illustrated electrical outlet assembly 102 is a generally rectangular, generally cube-shaped object so as to fit into the illustrated generally rectangular cavity 26 of a transverse member 14 of a furniture assembly 10. The generally cube shaped assembly 102 is advantageous because it does not accidentally turn or pivot substantially within generally rectangular cavity 26. The assembly 102 is press-fit into the cavity 26 and the clip 106 locks within the cavity 26 of transverse member 14 in order to secure assembly 102 in place within cavity 26 when inserted. In other embodiments, the assembly 102 may be other shapes that allow it to fit snugly within a transverse member cavity and/or be press-fit within the cavity when inserted.

Clip 106 is disposed on a top outer surface of assembly 102 so as to enable hub 100 to snap into transverse member 14. In other embodiments, however, the clip of the present invention may be located on a side outer surface of an electrical outlet assembly. The clip 106 illustrated may also be made of materials similar to those described herein for the panel 104, the one or more tabs 120*a-b*, and/or the housings 108, 112. These materials may include, but are not limited to, rigid and/or semi-rigid materials with elastic properties such as rubbers, plastics, composites such as carbon fiber composite materials, and the like, for example.

As shown in FIGS. 4-7, the inner cavity 130 of hub 100 is an inner recessed portion defined by the three connected panels 116*a-c* of U-shaped linkage housing 112. The clip 106 may be accessed by reaching a finger and/or other tool into the cavity 130 and through aperture 114 within housing 112 defined by the panels 116*a-c* of housing 112. An electrical outlet 132*c* is positioned on one of the inner surfaces of the electrical outlet assembly 102. Other embodiments may include other outlets located one or more different inner surfaces. Other types of outlets may also be included in other embodiments.

Figure 4:
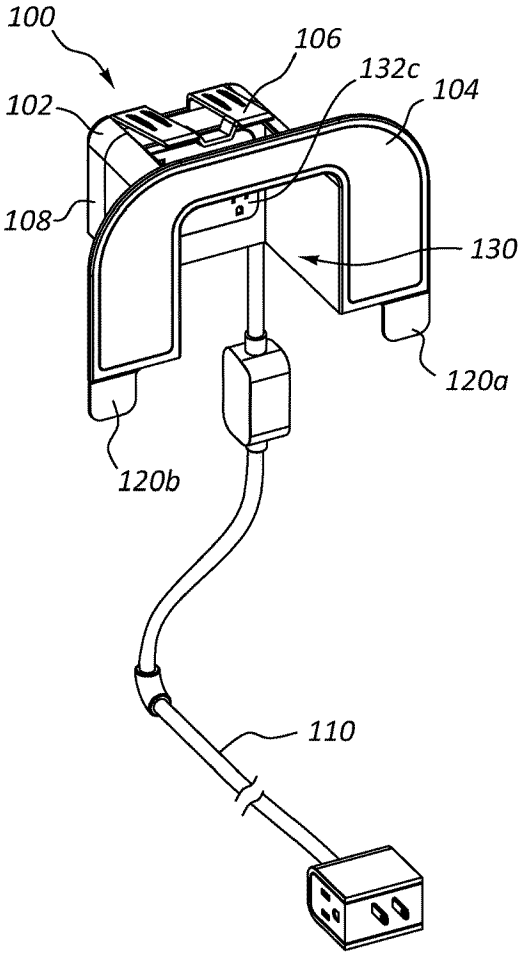
FIG. 4 illustrates a left front perspective view of the electrical hub of FIG. 2.
Figure 7:
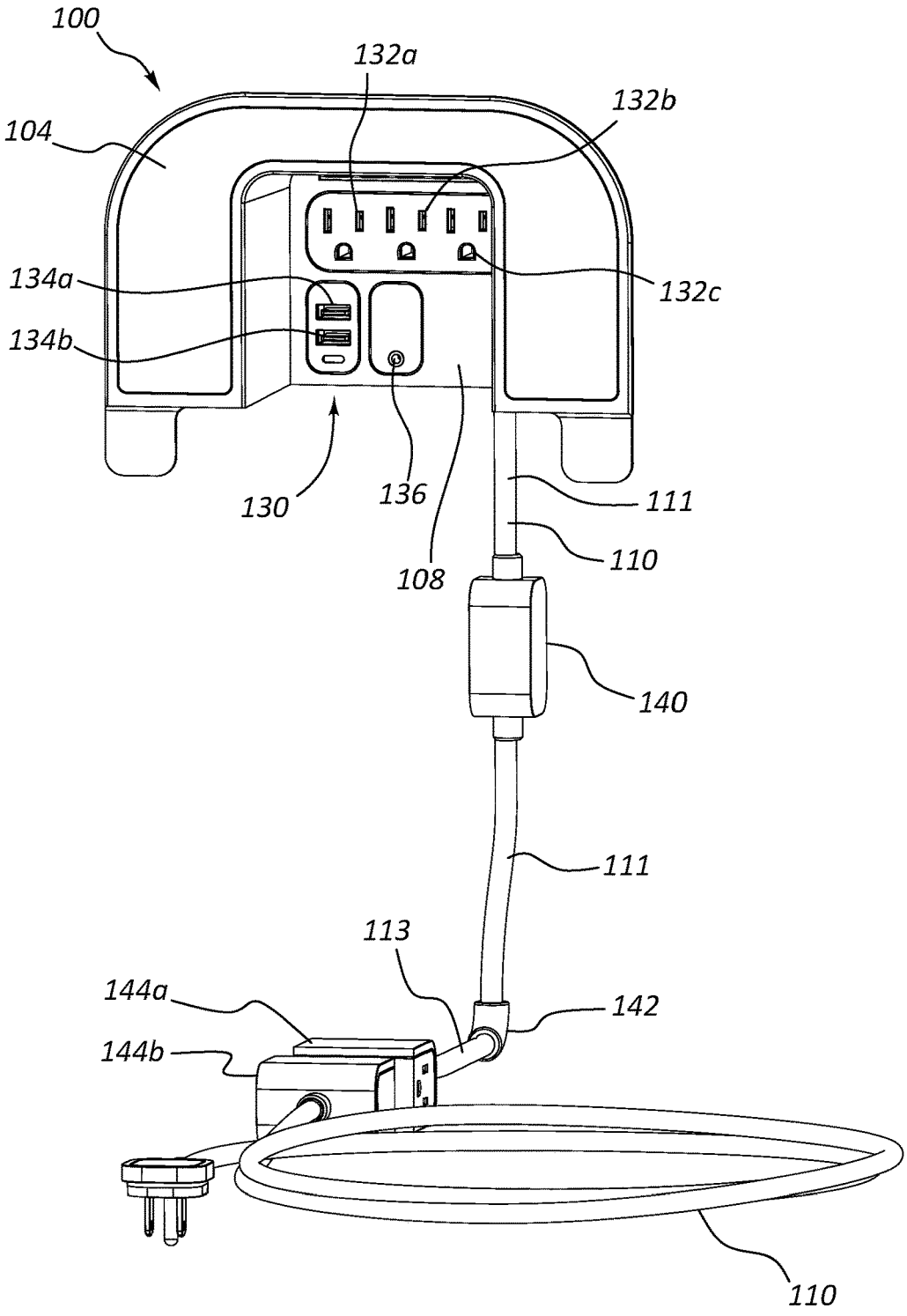
FIG. 7 illustrates another right front, perspective view of the electrical hub of FIG. 2.
Figure 8:
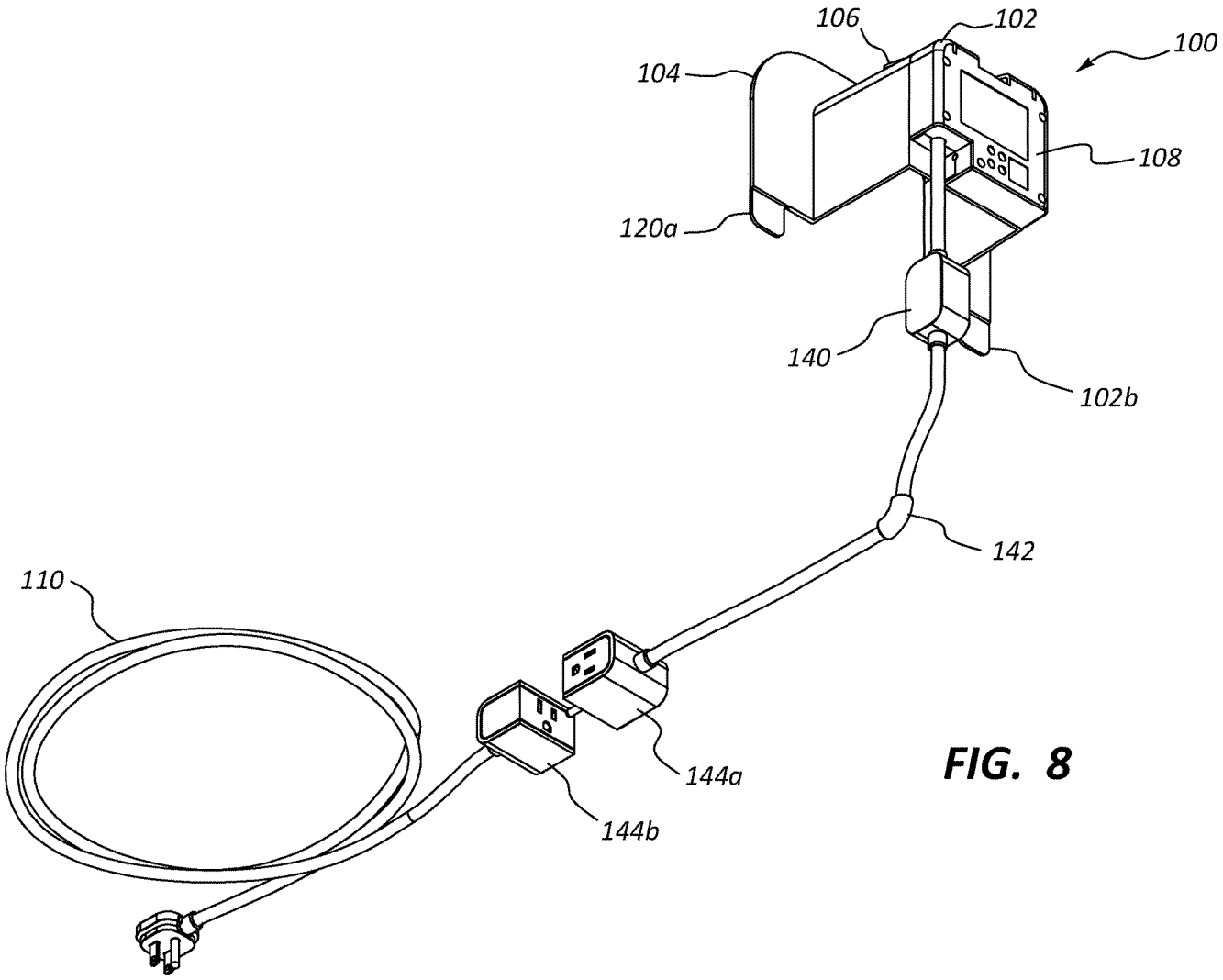
FIG. 8 illustrates a left, rear perspective view of the electrical hub of FIG. 2.

FIGS. 4 and 7 illustrate hub 100 further comprising USB ports 134*a-b*, electrical outlets 132*a-c*, an audio jack 136, and hub electrical cord 110 housed within covering housing 108. For example, other embodiments may include one or more USB ports, audio jacks, HDMI ports, other electrical outlets, and so forth. Other embodiments may include other outlets such as, for example, video ports, 220-Volt electrical outlets, and the like.

The hub electrical cord 110, which is electrically coupled to the one or more outlets of assembly 102 extends from covering housing 108. The hub electrical cord 110 receives power from a power source and delivers it to the outlet(s) of the hub 100.

Electrical cord 110 is comprised of (i) a first electrical cord member 111 extending from housing 108; (ii) a first cord outlet, i.e., an internal cord outlet 140 mounted on the electrical cord member 111; (iii) a second cord outlet, i.e., a floor resting outlet 144*a*, which is mounted on cord member 111 and conveniently rests on the floor below a base and/or transverse member; and (iv) a tether outlet 144*b*, which tethers to the floor resting outlet 144*a* and which has a cord member 113 connected thereto for plugging into a source of electrical power, such as wall outlet 18. Internal cord outlet 140 is positioned in FIG. 13A within the body of transverse member 14. A cord elbow 142 is mounted on electrical cord 110.

The illustrated cord outlets 140, 144*a-b* accommodate a standard 110-Volt plug, in one embodiment. Other embodiments may include cord outlets that accommodate 220-Volt plugs and/or other standard or non-standard electrical plugs. The cord outlets 140, 144*a-b* are configured to have electronic devices plugged into them as illustrated in the drawings. In some embodiments, these devices may include other hubs 100. In some embodiments, other electrical devices that may be plugged into the cord outlets 140, 144*a-b* include, but are not limited to, table and/or floor lamps, mobile computing devices, speakers, charging devices, stereo systems, vacuums, heaters, fans, household appliances, and the like, for example.

Cord outlets 140, 144*a-b* may have one or more electrical outlets on one side side thereof or on both sides thereof. Electrical outlet assembly 102 may have one, two or three or more electrical outlets, depending upon a particular use or embodiment.

As shown in FIGS. 9-10, the hub 100 is selectively secured at least partially within the cavity 26 of the transverse member 14 with the securement panel 104 outside the cavity 26 adjacent the surface of member 14. FIGS. 9-10 also illustrate how clip 106 may be manipulated using a hand and/or other tool in order to snappingly secure hub 100 into member 14 and/or remove the hub 100 when desired. The clip 106 illustrated in FIG. 10 is spring loaded and biased in the position shown in FIG. 9. For example, the clip 106 may be made of a semi-rigid plastic material that can elastically deform when a force is applied, but elastically return to position when the force is removed. Other rigid or semi-rigid materials that exhibit spring-like elastic behavior when bent may also be suitable material for the clip 106. These may include, but are not limited to, rubber materials, plastics, composite materials including carbon fiber composites, and the like, for example.

For insertion into cavity 26, clip 106 is manipulated downward, allowing the hub 100 to be inserted in member 14. After the hub 100 has been fully inserted into cavity 26, the clip 106 returns to the extended position of FIG. 9 within cavity 26 and behind the frame structure of transverse member 14, as shown in FIG. 9, due to the spring loaded nature of the clip 106. In the fully inserted position illustrated of FIG. 9, the clip 106 thus prevents the hub 100 from being removed from the cavity 26 of member 14.

A finger or other tool can be used to grab hold of the clip 106 and manipulate it downward in order to remove the hub 100 from the cavity 26 when desired, as illustrated in FIG. 10. Other embodiments may include clips that perform the same function and are able to be manipulated with a finger and/or other tool in order to lock a hub 100 into cavity 26 and remove the hub 100 by manipulating the clip 106 when removal of the hub 100 is desired. Other embodiments of the clip 106 may include coil springs that bias the clip 106 upward. Other self-biasing, spring loaded clips are contemplated.

After hub 100 is removed from a transverse member 14, hub 100 can be conveniently relocated into another transverse member 14.

Figure 12:
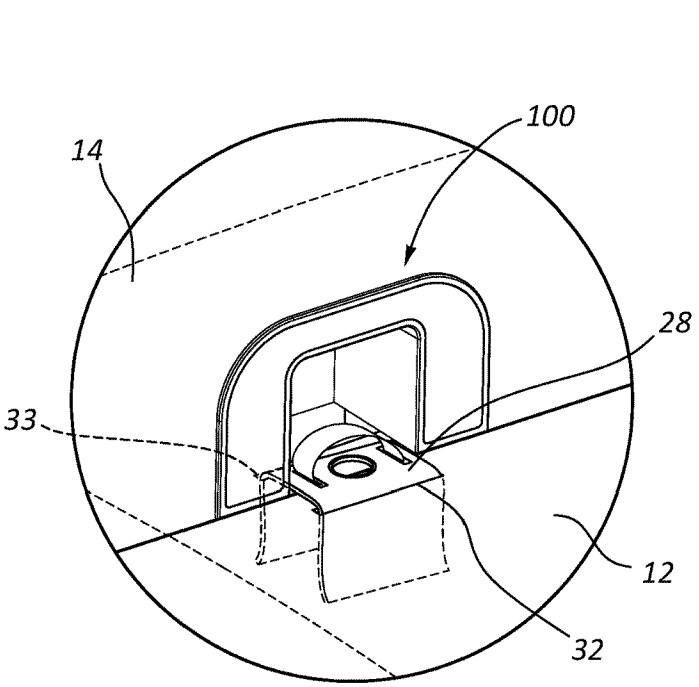
FIGS. 11-12 illustrate perspective and close up views, respectively of the Furniture assembly of FIG. 1.
Figure 11:
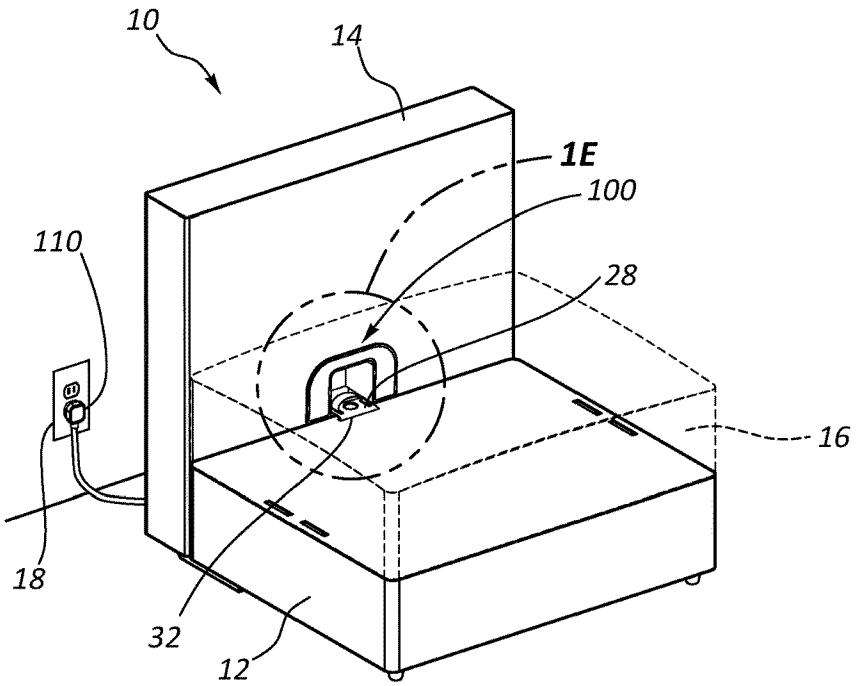

FIG. 11 illustrates hub 100 secured within cavity 26 of member 14 of furniture assembly 10 and shows electrical cord 110 plugged in to an external power source, such as a wall outlet 18. Any external power source may be used, for example a power strip or other power source. FIG. 11 illustrates how cushion 16 (shown in dotted lines) is placed on the base member 12 in order to visually block the hub 100 from view. FIG. 12 is a zoomed in view of how the hub 100 is positioned within the cavity 26.

In one embodiment of a method of assembling an electronic furniture assembly of the present invention, base 12 and transverse member 14 are provided, hub 100 is placed within transverse member 14, then coupler 28 is placed within base 12 and transverse member 14, coupling base 12 to transverse member 14, as shown in FIGS. 11-12. In such an embodiment, both hub 100 and coupler 28 are conveniently placed within cavity 26 of transverse member. Hub 100 thus conveniently and effectively uses the same cavity 26 that is employed by U-shaped coupler 28.

As illustrated in FIGS. 7 and 12, the cavity 130 formed within hub 100 provides a convenient protective area through which to move coupler 28 and within which to place the plugs the cords of electrical devices, such as telephones, etc. Securement panel 104 defines a plane extending therethrough, wherein the securement panel 104 is linked to and spaced away from the electrical outlet assembly 102, such that at least one outlet of the electrical outlet assembly 102 is offset from the plane of the securement panel 104, the linkage housing portion 112 of the assembly 102 providing a convenient, protective area within which to plug the cords of the one or more electrical devices.

The protective area of cavity 130 of hub 100 enables coupler 28 to conveniently extend into base 12 and member 14 and further enables plugs of such devices to be plugged into the electrical outlets of hub 100 and provides a covered, protected area that protects the interface between the electrical outlets of hub 100 and the portions of the cords of the electrical devices (e.g. telephone charging cords) that plug into the electrical outlets. The protective area provided by cavity 130 thus enables the plug portions of electrical cords of telephones, lamps and other electrical devices to be protected as they are plugged into and remain within hub 100. Other hub designs can provide protective areas, such as hubs having an upper covering (e.g., roof) section and/or one or more side wall sections.

Figure 13A:
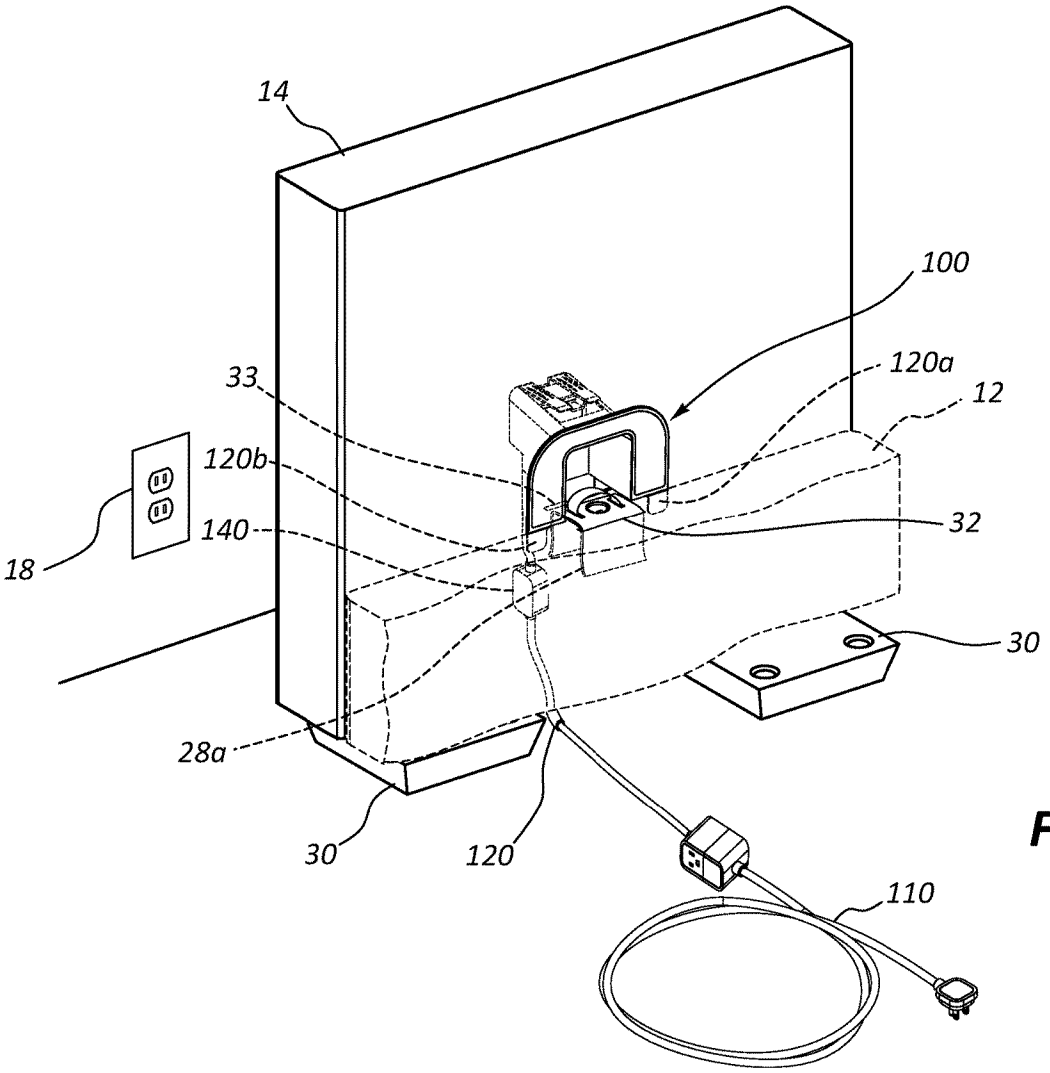
FIGS. 13A-B illustrates cutaway perspective views of the furniture assembly of FIG. 1.
Figure 13B:
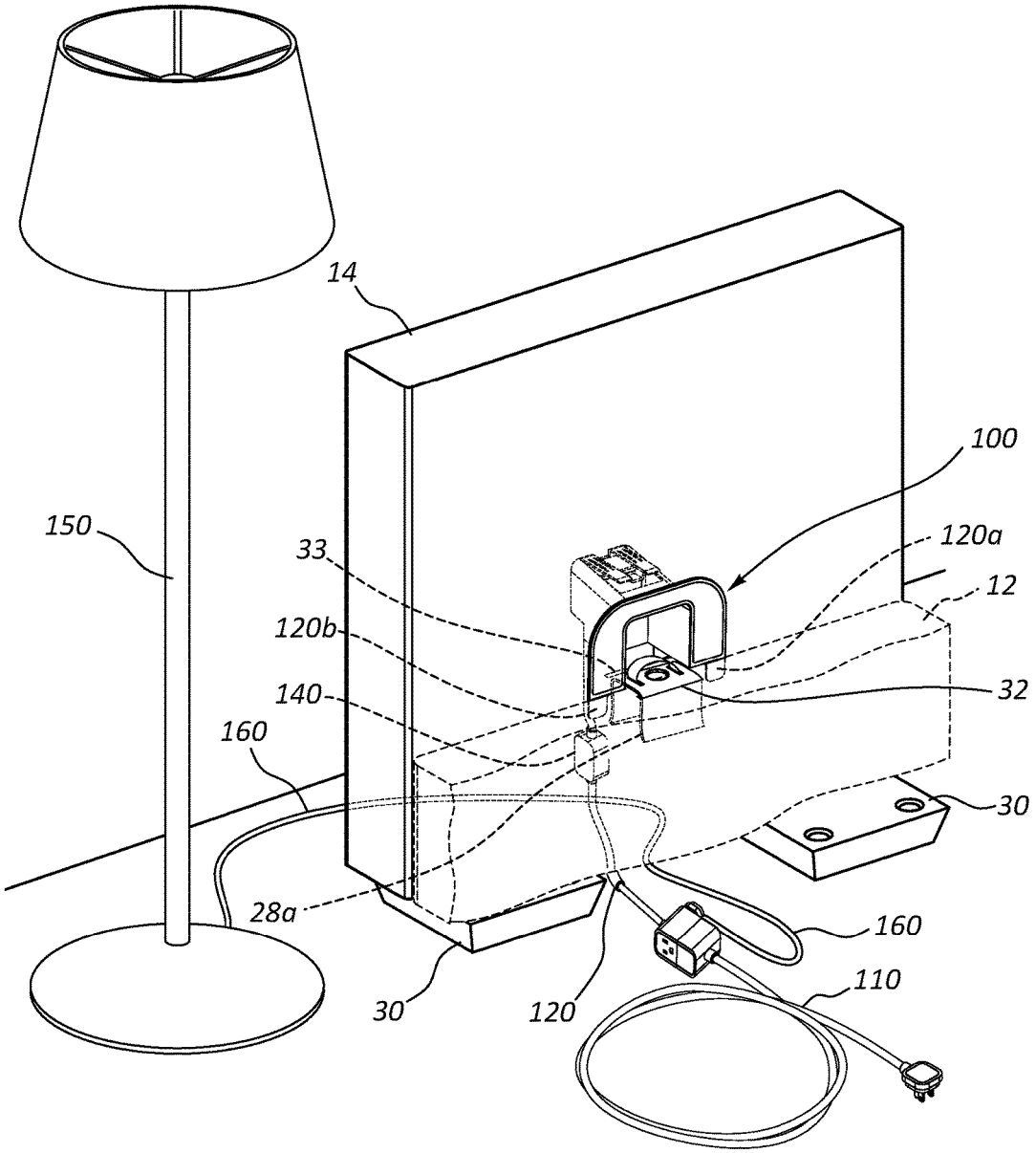
Figure 14:
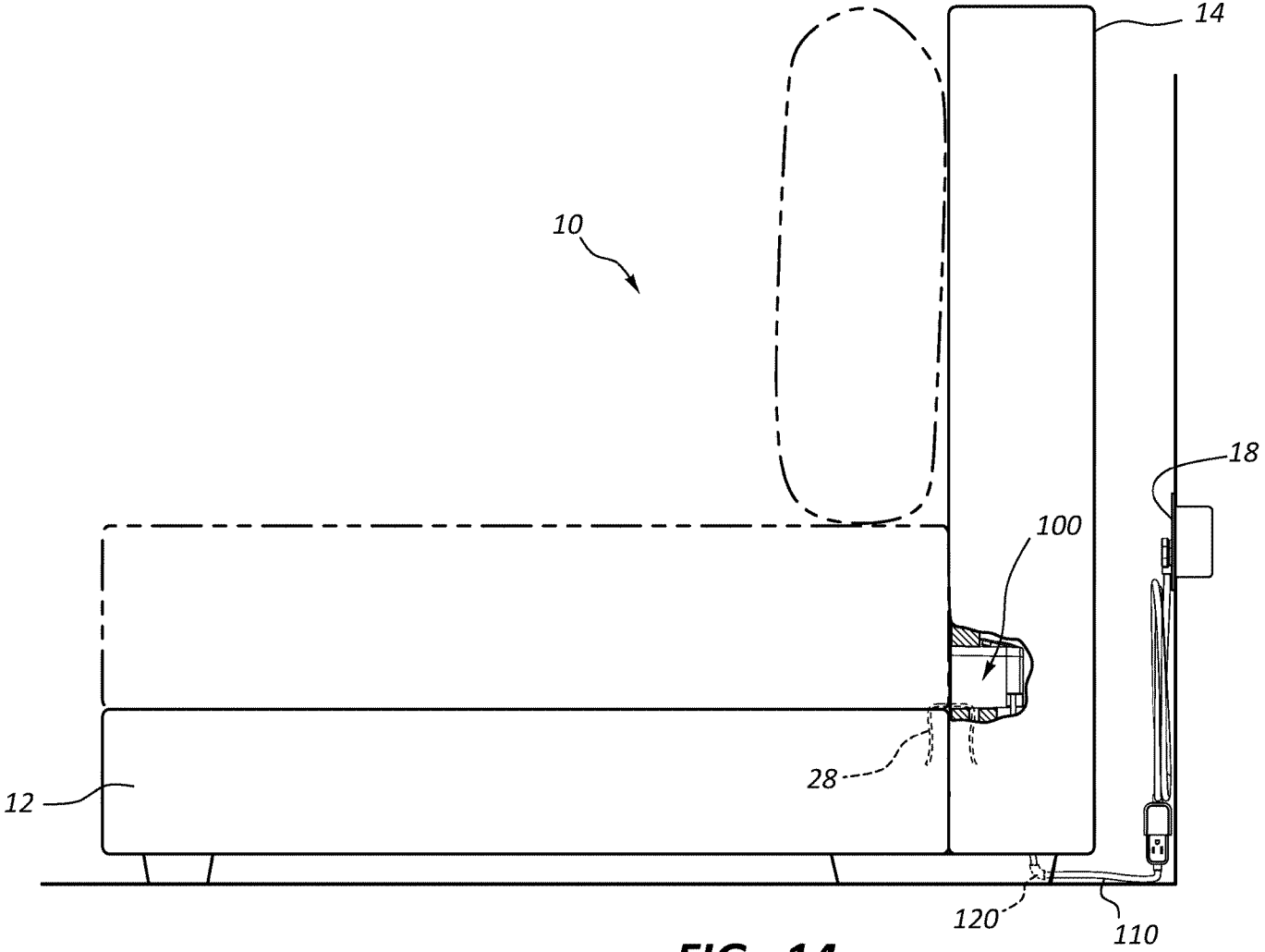
FIG. 14 illustrates a cross-sectional side view of the furniture assembly of FIG. 1.

As shown in FIGS. 13A-13B, the hub electrical cord 110 extends from the hub 100, through the transverse member 14, out of a hole in the bottom portion of the frame of the transverse member 14 and below transverse member 14, so that the hub electrical cord 110 can be plugged in to an external power source. The illustrated hub electrical cord 110 is flexible and in some of the embodiments shown, e.g., in FIGS. 13-14 is comprised of a plurality of extension cords. An electrical device such as lamp 150 has a cord 160 thereof conveniently connected to floor resting cord outlet 140*a* as shown in FIG. 13B. Electrical cord 110 is thus advantageous because cord outlets such as floor resting cord outlet 140*a* can power an electrical device such as lamp 150 and hide at least a portion of the corresponding electrical cord 160 from view, providing a more functional furniture assembly and a more pleasing aesthetic appearance.

Cord elbow 120 extending about electrical cord 110 is also illustrated. The cord elbow 120 is a rigid or semi-rigid component (comprised, e.g., of a hard plastic) positioned about cord 110 in a bending, elbow shape along the length of the hub electrical cord 110. The cord elbow 120 is positioned about the hub electrical cord 110 so as to facilitate a convenient permanent bending of the hub electrical cord 110 while simultaneously protecting the bent portion of cord 110. In one embodiment, the cord elbow 120 bends the hub electrical cord 110 at a position where the hub electrical cord 110 reaches the floor or other surface when extending between the electrical outlet assembly 102 and a power source, such as a wall outlet 18.

Elbows such as cord elbow 120 provide a protected, smooth transition from a vertical orientation to a horizontal orientation, and may be comprised of a variety of different materials, such as a hard plastic, or a rubber, neoprene, silicone or other material that can be wrapped around and electrical cord and form a rigid or semi-rigid tubular member wrapped around the cord. Elbows such as cord elbow 120 extending about cord thus protect the electrical cord from breaking or fraying while bending, minimize the amount of electrical cord seen, and in some instances hides the electrical cord from view.

Also as shown in FIGS. 13A-B, one coupler plate 28*a* of coupler 28 is configured to fit within a corresponding apertures 32 of base 12 while another plate of coupler 28 fits within a corresponding aperture 33 of transverse member 14 to thereby selectively connect base 12 to member 14. As shown, in one embodiment, U-shaped coupler 28 has a ribbon handle attached thereto for removing coupler 28 from respective apertures 32, 33 and may have a hole in a top portion thereof, which assists in reducing the weight of the coupler 28. In other embodiments, the hole and ribbon are not employed.

Figure 16:
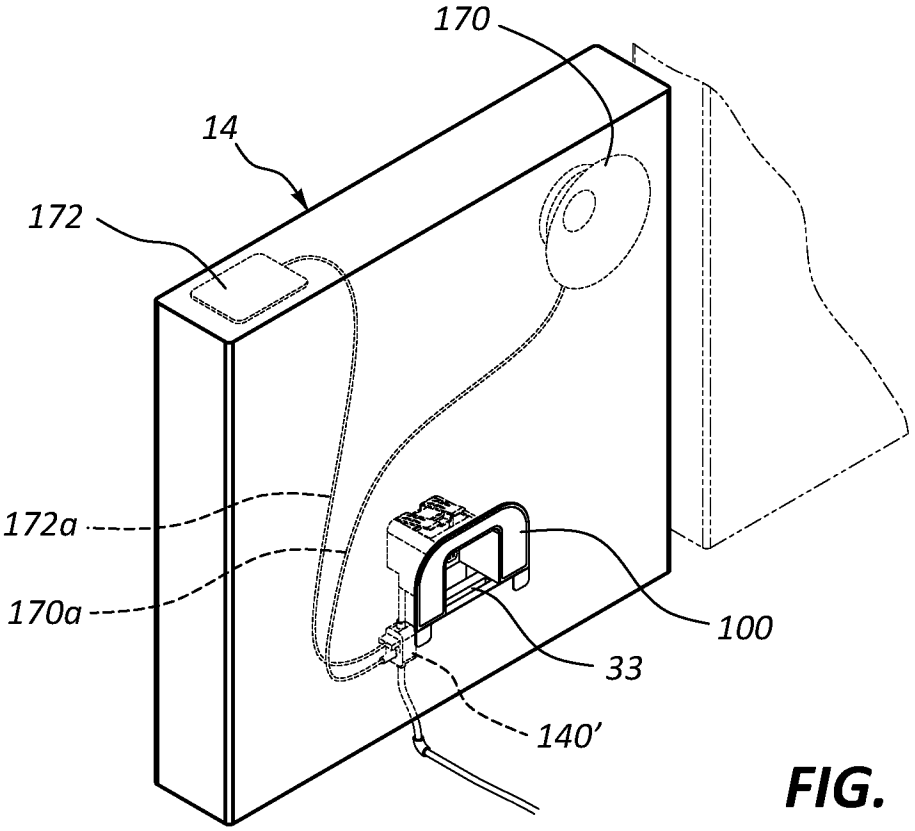
FIG. 16 illustrates a transverse member of the present invention having an electrical hub 100 mounted therein, wherein a speaker and an induction charger are electrically coupled to an interior outlet of the electrical hub, the speaker and induction charger being mounted within the transverse member.
Figure 18:
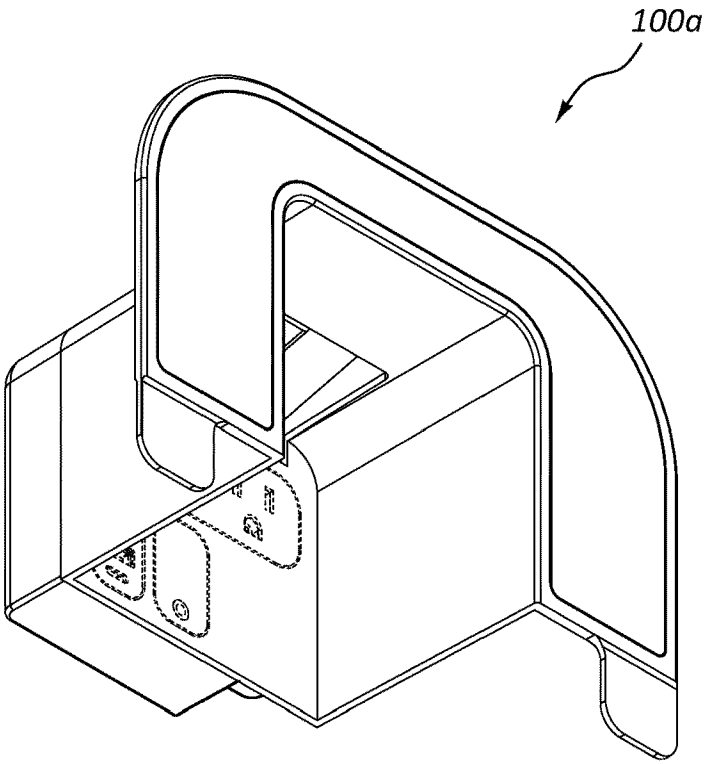
FIGS. 17-26 reflect design drawing views of an electrical hub 100*a* for furniture of the present invention, wherein the broken lines are shown for environmental purposes only.
Figure 17:
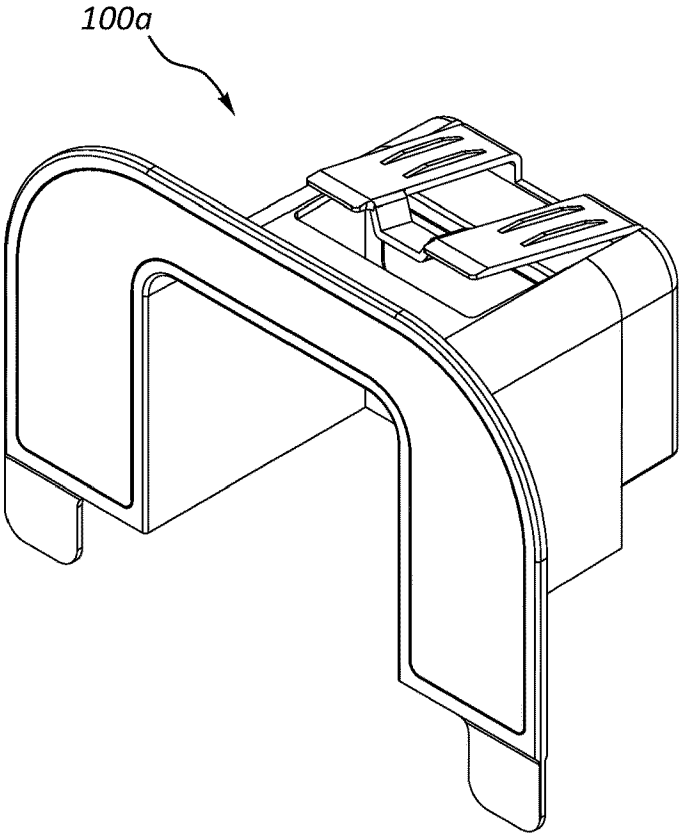
Figure 20:
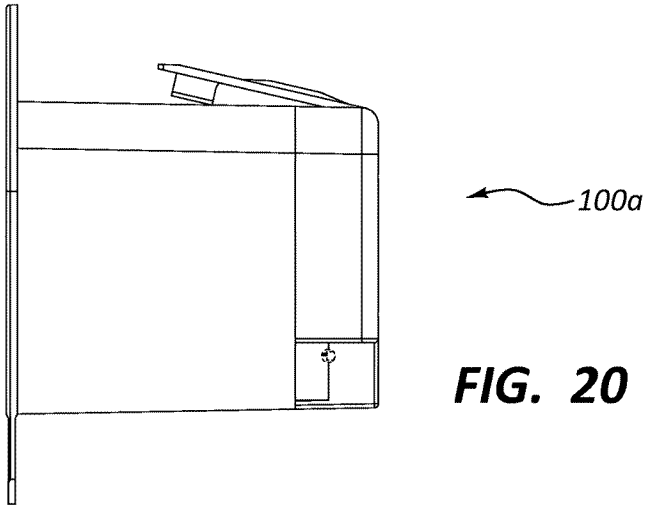
Figure 21:
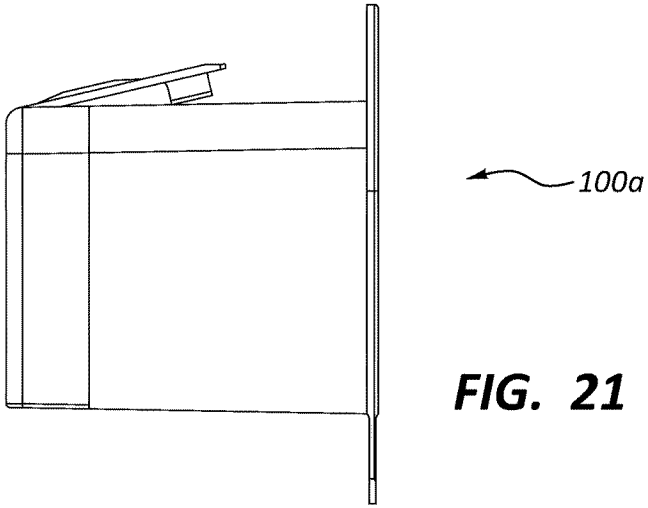
Figure 19:
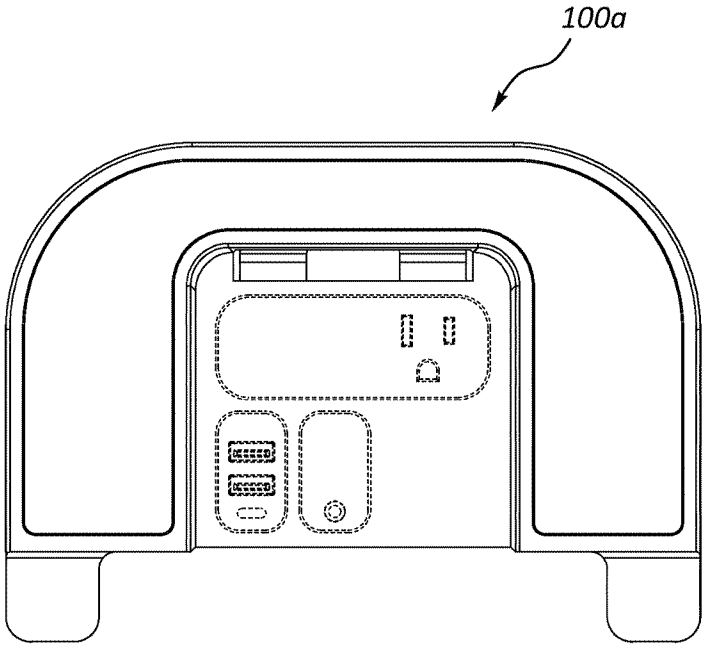
Figure 23:
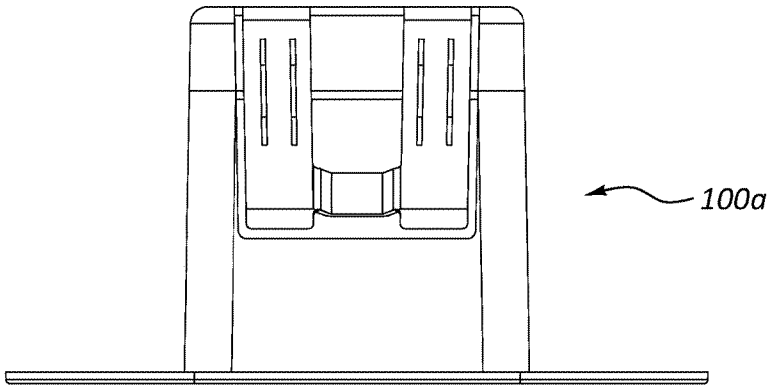
Figure 24:
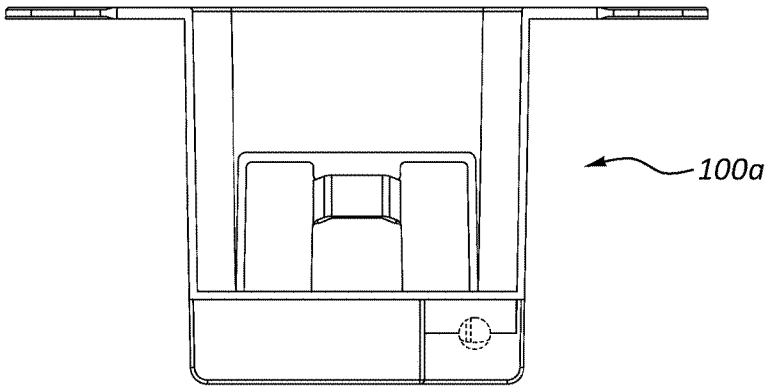
Figure 22:
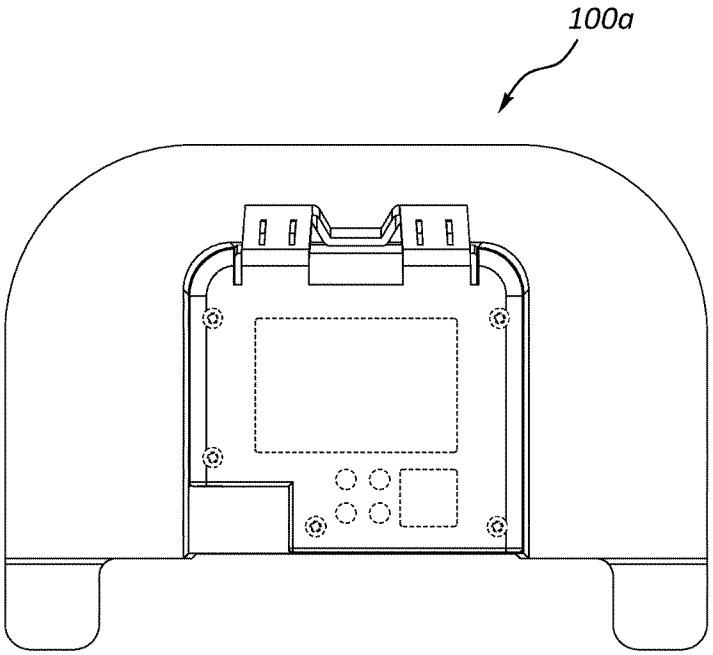
Figure 26:
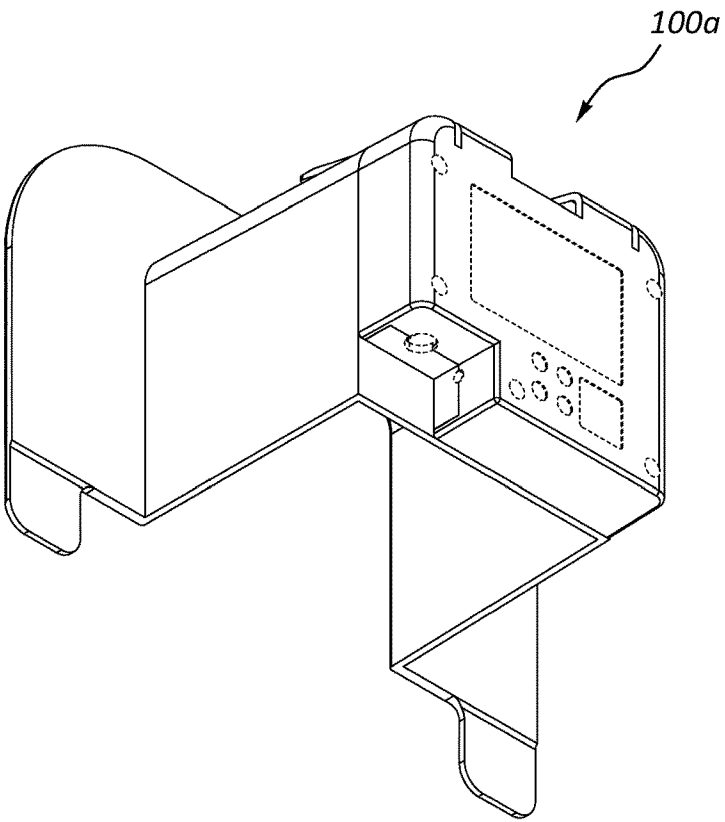
Figure 25:
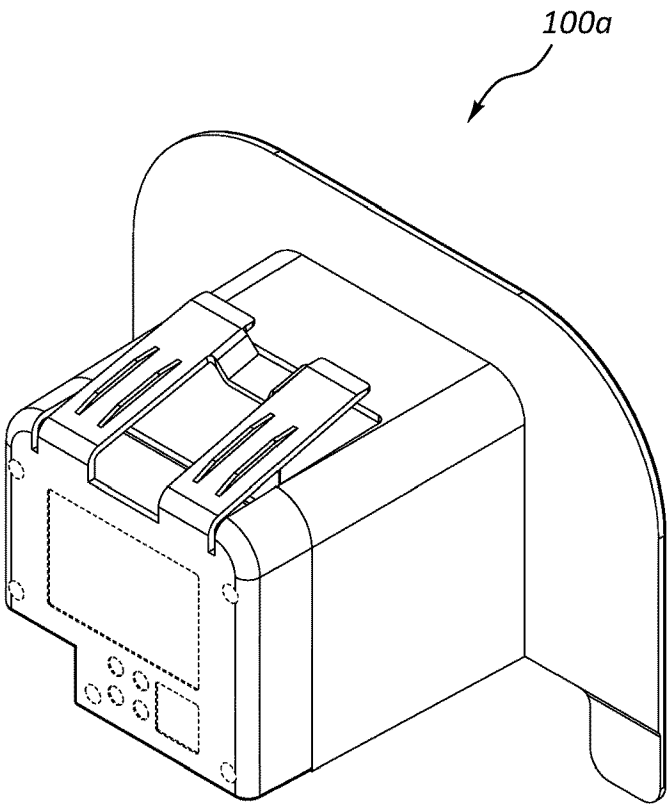

FIGS. 13B and 16 further show the convenience and utility of internal cord outlet 140 or 140' mounted within the body of transverse member 14, which accepts the cord 160 of a lamp 150, and/or the respective cords 170*a*, 172*a* of one or more speakers 170 and one or more wireless electrical induction chargers 172 mounted within transverse member 14. Induction charger 172 can be mounted under the fabric within a transverse member 14, for example for conveniently, wirelessly charging electronic devices wireless, e.g. a phone and/or computer placed by a user on a transverse member 14.

Figure 15:
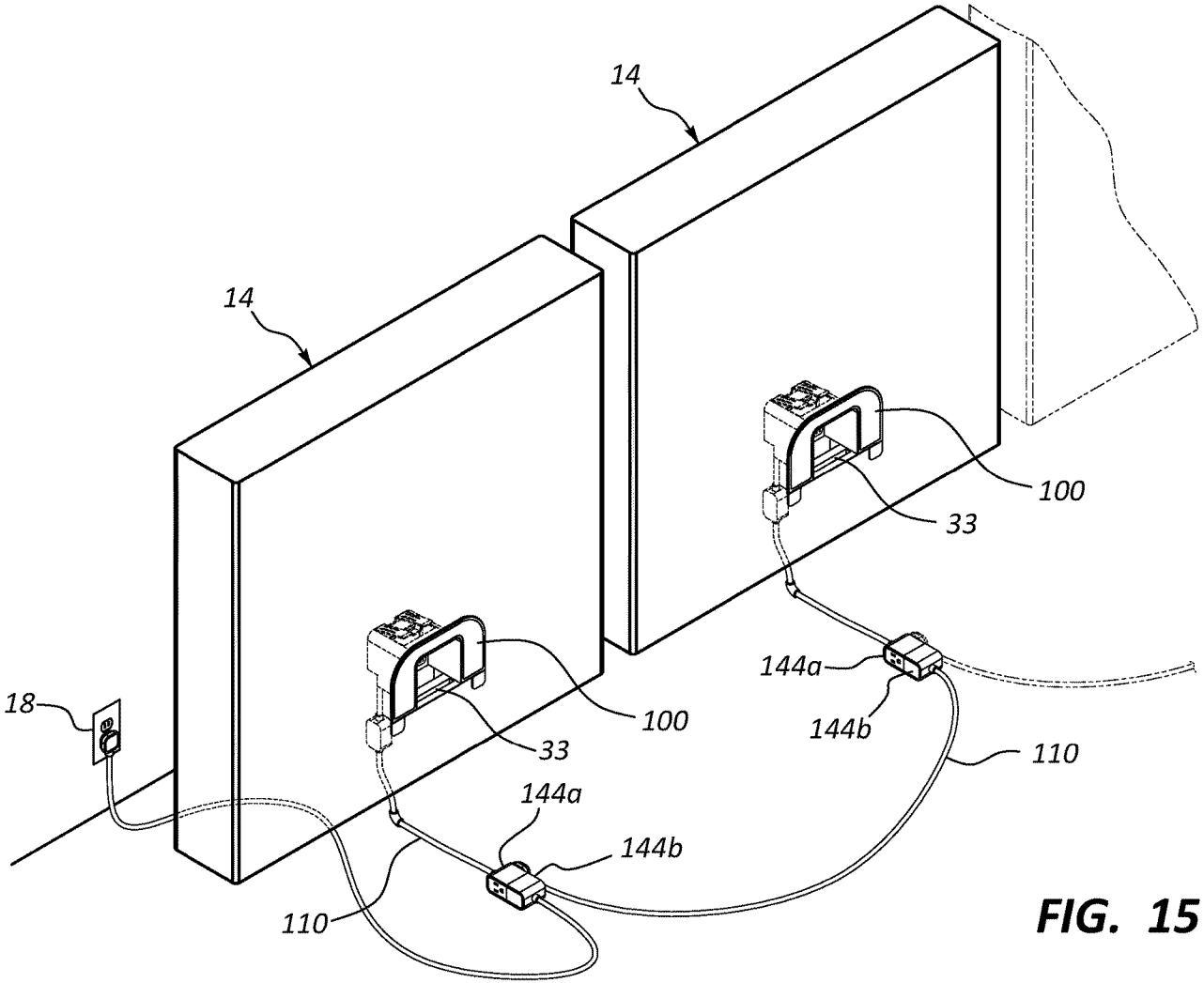
FIG. 15 illustrates a perspective view of a modular furniture system comprising two transverse members electronically linked in a series. Bases that correspond to the transverse members of FIG. 15 are not shown in FIG. 15, but can be mounted against the corresponding transverse member as illustrated in FIGS. 1-2 and 9-14, for example.

FIGS. 13-15 further illustrate cord elbows 120. Other embodiments of electrical cords of the present invention may include none or two or more cord elbows on a cord in order to bend the hub electrical cord 110 wherever a bending of the hub electrical cord 110 may be desired. In certain embodiments, the cord elbow 120 bends the hub electrical cord 110 at approximately a ninety-degree angle. In other embodiments, the cord elbow of the present invention bends a hub electrical cord at approximately a forty-five degree angle. Other embodiments of the hub 100 may include elbow cords 120 that bend the hub electrical cord 110 at other angles greater or less than ninety degrees or greater or less then forty-five degrees. For example, other embodiments may include a cord elbow 120 that bends the hub electrical cord 110 at approximately a thirty degree angle or approximately a thirty-three-degree angle, and so forth.

FIG. 14 illustrates hub 100 at least partially secured within a cavity 26 of a furniture assembly 10. The furniture assembly includes a transverse member 14 and a base member 12. The hub 100 is at least partially secured within the cavity 26 and a hub electrical cord 110 extends from the electrical outlet assembly 102 to a wall outlet 18. FIG. 14 illustrates how electrical cord 110 extends out of an opening in the bottom of transverse member 14 and how the cord elbow 120 facilitates a bending of the hub electrical cord 110 at the floor, similar to the cord elbow 120 illustrated in FIG. 13 and described above.

FIG. 14 illustrates a modular furniture assembly 10 as disclosed in U.S. Pat. No. 7,213,885, which is incorporated herein by reference, and in the other patents referenced above. The illustrated furniture assembly 10 includes a transverse member 14 and a base member 12. The transverse member 14 includes a cavity 26 and the base member 12.

With continued reference to FIG. 14, once hub 100 is mounted within transverse member 14, coupler 28 is selectively inserted through cavity 130 of hub 100 into apertures in the base and transverse member such that the coupler 28 detachably couples the base member 12 to the transverse member 14, as described in U.S. Pat. No. 7,213,885, which is incorporated herein by reference. The hub 100 is configured to fit at least partially within the cavity 26 of the transverse member 14. The panel 104 of the hub 100 is positioned adjacent to an outer surface of the transverse member 14.

FIG. 15 illustrates a system of two hubs 100 connected together via cord outlets located on respective electrical cords 110. The hubs 100 are secured at least partially within respective cavities 26 of respective transverse members 14, to which bases 12 can be selectively coupled. Hubs 100 each include a hub electrical cord 110 comprising one or more cord outlets. The hub electrical cord 110 of one hub 100 is plugged into the hub electrical cord 110 of the other hub 100. The other hub electrical cord 110 is plugged into the wall outlet 18. In this way, both hubs 100 receive electrical power from a single hub electrical cord 110 being plugged into a single power source, such as the wall outlet 18.

FIG. 15 thus illustrates a system of at least two hubs 100 and at least two transverse members, but other embodiments of a system of hubs and transverse members may include more than two hubs connected to each other. The plurality of hubs connected to each other may reside in any configuration of furniture assemblies that include transverse members or bases or other members configured to receive electrical hubs, such as the various furniture assembly embodiments described in U.S. Pat. No. 7,213,885 and the other patents and applications incorporated herein by reference. In some embodiments, the system of two or more hubs may be connected via hub electrical cords that run underneath various base members, within various base members, within various transverse members, behind various transverse members, and so forth.

FIG. 16 illustrates a transverse member 14 of the present invention having an electrical hub 100 mounted therein, wherein a speaker 170 and an induction charger 172 are electrically coupled to an interior outlet 140' of the electrical hub, the speaker 170 and induction charger 172 being mounted within the transverse member 14. In various embodiments, outlet 140' has one, two, or more than two electrical outlets. In addition, one or more additional transverse members similar or identical to the transverse member 14 of FIG. 16 with a hub 100, a speaker 170, a charger 172 and one or more of the other features shown in FIG. 16 mounted therein can also be provided in order to provide stereo and surround sound and in order to provide a conveniently wired electrical furniture assembly. Using induction charger 172 mounted within a transverse member 14, a user seated on a furniture assembly 10 can conveniently recharge an electrical device, such as a cellular phone, while seated on the modular furniture assembly.

Various electronic devices can be electrically coupled to the 132*a-c* of the electrical outlet assembly 102 or to the interior outlet 140' shown in FIG. 16, such as speakers, induction chargers (e.g., under the fabric of a transverse member serving as an arm rest), refrigerators, amplifiers for a surround sound system, and a vast number of other electrical devices that are convenient to have in a furniture assembly.

Although clip 106 is highly useful, a variety of other mechanisms can be employed for selectively mounting hub 100 within a furniture assembly. For example, in one embodiment, a hub of the present invention is mounted within a cavity such as cavity 26 of a furniture assembly 10 without the use of a clip, such as by a friction fit or simply resting within cavity 26 without the use of a clip. In other embodiments, a non-moveable clip, a permanent clip, screws, nails, adhesives, two part fasteners or other mechanisms are used to selectively mount hub 100 within a furniture assembly.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An electrical hub configured to selectively reside within a furniture assembly, the electrical hub comprising:

an electrical outlet assembly having a housing and at least one electrical outlet at a rear portion of the housing;

a securement panel extending from a front portion of the housing, the securement panel being spaced away from the at least one electrical outlet of the electrical outlet assembly, such that the at least one outlet of the electrical outlet assembly is offset from the securement panel;

the housing comprising a linkage housing portion that defines a convenient, recessed area located between the front and rear portions of the housing within which to receive portions of cords of one or more electrical devices, the hub being configured to be selectively mounted within a furniture assembly in order to provide a source of electrical power for the one or more electrical devices, the electrical hub further comprising:

an installation clip, mounted to the electrical outlet assembly, a free end of the installation clip being moveable with respect to the electrical outlet assembly, the installation clip having a compressed position and an extended position, the installation clip being configured to be selectively moved by a user from the extended position to the compressed position in order to selectively mount the electrical hub within the furniture assembly, wherein the housing is open at a front and bottom thereof for accessing the recessed area, such that the recessed area is configured to enable the user to move the installation clip between the extended position and the compressed position.

2. An electrical hub as recited in claim 1, wherein the installation clip is cantilevered from the electrical outlet assembly such that the installation clip is spring-loaded in the compressed position, wherein the installation clip is moveable from the extended position to the spring-loaded, compressed position by applying a force against the clip, such that when the force is removed from the clip, the clip resiliently returns to the extended position.

3. An electrical hub as recited in claim 1, wherein the housing of the electrical outlet assembly comprises a covering housing portion, and comprises one or more electrical outlets, and an electrical cord extending away from the housing so as to be connectable to a source of electrical power.

4. An electrical hub as recited in claim 3, wherein the linkage housing has a central panel, a left side panel, and a right side panel, each panel of the housing being substantially perpendicular to the securement panel, wherein the installation clip is mounted on the covering housing portion of the electrical outlet assembly.

5. An electrical hub configured to selectively reside within a furniture assembly, the electrical hub comprising:

an electrical outlet assembly having at least one electrical outlet in a first plane, the electrical outlet assembly having a covering housing;

a securement panel in a second plane, the second plane being parallel to the first plane, the securement panel having a front face and a rear face;

a linkage housing that links the covering housing of the electrical outlet assembly to the securement panel, the linkage housing defining a convenient, recessed area located behind the second plane, such that the second plane is spaced away from the first plane and such that the at least one electrical outlet of the electrical outlet assembly is recessed relative to the securement panel; and an installation clip mounted in a cantilevered relationship to the electrical outlet assembly, the installation clip having a spring-loaded, compressed position and an extended position, wherein the installation clip is moveable from the extended position to the spring-loaded compressed position by applying a force against the clip, such that when the force is removed from the clip, the clip resiliently returns to the extended position a free end of the installation clip configured to be selectively moved by a user from the extended position to the spring-loaded, compressed position in order to enable the electrical hub to be mounted within the furniture assembly, wherein the linkage housing is open at a front thereof for accessing the recessed area, such that the recessed area is configured to enable the user to move the installation clip between the extended position and the spring-loaded, compressed position.

6. An electrical hub as recited in claim 1, wherein the installation clip is a resiliently mounted clip that has a finger opening therein, at least a portion of the installation clip being movable towards the recessed area by inserting a finger within the finger opening and pulling the free end of the installation clip towards the recessed area into a spring-loaded, compressed position, such that the user can pull the free end of the installation clip towards the recessed area into the spring-loaded compressed position and then insert the hub into the furniture assembly, then allow the clip to return to the extended position by releasing the clip, thereby engaging the furniture assembly with the clip, and such that the user can thereafter pull the free end of the installation clip towards the recessed area, into the spring-loaded compressed position, thereby disengaging the clip from the furniture assembly.

7. An electrical hub as recited in claim 1 wherein the securement panel has one or more tabs extending from a lower portion thereof, the tabs being configured to be sandwiched between two different portions of a furniture assembly when the electrical hub is mounted within the furniture assembly.

8. An electrical hub as recited in claim 1 wherein the electrical outlet assembly comprises an electrical cord and at least one protective cord elbow mounted on the electrical cord.

9. The electrical hub of claim 1, wherein the securement panel is a U-shaped, generally planar panel, and wherein the securement panel includes a central panel member extending upwardly from the housing that forms a center portion of the U, a left panel member extending outwardly from the housing that forms a left side of the U, and a right panel member extending outwardly from the housing that forms a right side of the U, the central panel member, left panel member, and right panel member all being in a same plane at the front portion of the housing, so that the U-shape of the securement panel is oriented with the open end of the U oriented downwards.

10. The electrical hub of claim 1, wherein the housing comprises a covering housing portion housing the at least one electrical outlet and wherein the linkage housing portion has a central panel, a left side panel, and a right side panel that extend between the covering housing portion and the securement panel, each panel of the linkage housing portion being substantially perpendicular to at least one of the securement panel or the at least one electrical outlet.

11. The electrical hub of claim 1, wherein the at least one electrical outlet of the electrical outlet assembly is fixed in position relative to the housing.

12. An electronic furniture assembly configured to be coupled to one or more electrical devices, comprising:

a furniture assembly comprising:

(A) a base having a seating surface; and (B) a transverse member providing at least one of: (i) an armrest surface or (ii) a backrest surface; and (ii) an electrical hub configured to be selectively positioned within the furniture assembly, the electrical hub comprising:

an electrical outlet assembly having a housing and at least one electrical outlet at a rear portion of the housing; and a securement panel at a front portion of the housing, extending from the housing, the securement panel being spaced away from the at least one electrical outlet such that a recessed area is located between the securement panel and the at least one electrical outlet, wherein the housing is open at a front and bottom thereof for accessing the recessed area, and wherein at least a portion of the electrical hub is selectively mounted within a cavity of the furniture assembly, the electrical hub further comprising an installation clip mounted to the electrical outlet assembly, such that the clip is accessible through the recessed area.

13. An electronic furniture assembly as recited in claim 12, wherein the installation clip is mounted in a cantilevered relationship to the electrical outlet assembly, the installation clip having a spring-loaded, compressed position and an extended position, wherein the installation clip is moveable from the extended position to the spring-loaded, compressed position by applying a force against the clip, such that when the force is removed from the clip, the clip resiliently returns to the extended position, a free end of the installation clip configured to be selectively moved by a user from the extended position to the spring-loaded, compressed position in order to enable a user to mount the electrical hub within the furniture assembly, the installation clip being configured to be selectively moved by a user from the extended position to the spring-loaded, compressed position in order to enable a user to remove the electrical hub from the furniture assembly.

14. An electronic furniture assembly as recited in claim 12, further comprising a coupler for selectively coupling the base to the transverse member, wherein the hub is selectively mounted adjacent the coupler within the furniture assembly.

15. An electronic furniture assembly as recited in claim 14 wherein at least a portion of the hub and at least a portion of the coupler are selectively mounted within a cavity of the transverse member.

16. An electronic furniture assembly as recited in claim 14, wherein the electrical outlet assembly of the hub is mounted adjacent the coupler within the cavity of the transverse member and wherein an electrical cord of the hub extends out of a bottom portion of the transverse member.

17. An electronic furniture assembly as recited in claim 12, wherein the electrical hub is a generally cube-shaped member configured to be selectively inserted within a generally rectangular cavity of the furniture assembly.

18. An electronic furniture assembly as recited in claim 12, further comprising an induction charger mounted within the furniture assembly, the induction charger being configured to be electrically coupled to the electrical hub.

19. The electronic furniture assembly of claim 12, further comprising an installation clip cantilevered from the electrical outlet assembly such that the installation clip is spring-loaded in a compressed position, wherein the installation clip is moveable from the extended position to the spring-loaded, compressed position by applying a force against the clip, such that when the force is removed from the clip, the clip resiliently returns to the extended position.

20. The electrical hub of claim 5, wherein the linkage housing is open at a bottom thereof for accessing the recessed area, such that the recessed area is configured to enable the user to move the installation clip between the extended position and the spring-loaded, compressed position.

21. The electrical hub of claim 5, wherein the electrical hub further comprises one or more tabs extending downwardly from the securement panel, the tabs configured to be sandwiched between two different portions of a furniture assembly when the electrical hub is mounted within the furniture assembly.

22. The electrical hub of claim 5, wherein the rear face of the securement panel of the electrical hub is configured to be placed adjacent and generally flush with a surface of the furniture assembly.

23. The electrical hub of claim 5, wherein the electrical outlet assembly comprises an electrical cord with one or more cord outlets disposed along the length of the electrical cord, wherein the one or more cord outlets disposed along the length of the electrical cord comprise one or more of interior outlets, floor resting outlets, or tether outlets.

24. The electrical hub of claim 5, wherein the at least one electrical outlet of the electrical outlet assembly is fixed in position relative to the linkage housing.

25. An electrical hub configured to selectively reside within a furniture assembly, the hub being configured to be selectively mounted within a furniture assembly in order to provide a source of electrical power for one or more electrical devices, the electrical hub comprising:

an electrical outlet assembly having a housing and one or more electrical outlets at a rear portion of the housing, the housing comprising a covering housing portion which houses the one or more electrical outlets and a linkage housing portion that defines a cavity located between the one or more electrical outlets and a plane that is parallel to and spaced away from the one or more electrical outlets, the cavity configured to receive portions of one or more electrical devices therein; and an installation clip cantilevered from the electrical outlet assembly, a free end of the installation clip being moveable with respect to the electrical outlet assembly, the installation clip being configured to be selectively moved by a user from an extended position to a compressed, spring-loaded position by applying a force against the clip, such that when the force is removed from the clip, the clip resiliently returns to the extended position, the cavity configured to enable the user to access the installation clip in order to move the installation clip between the extended position and the compressed spring-loaded position.

26. The electrical hub of claim 25, wherein the housing is open at a front thereof for accessing the cavity, such that the cavity is configured to enable the user to move the installation clip between the extended position and the spring-loaded compressed position.

27. The electrical hub of claim 26, wherein the housing is open at a bottom thereof for accessing the cavity, such that the cavity is configured to enable the user to move the installation clip between the extended position and the spring-loaded compressed position.

28. An electrical hub configured to selectively reside within a furniture assembly, the hub being configured to be selectively mounted within a furniture assembly in order to provide a source of electrical power for one or more electrical devices, the electrical hub comprising:

an electrical outlet assembly having a housing and having one or more electrical outlets in a first plane at a rear portion of the housing, the housing comprising a covering housing portion which houses the one or more electrical outlets and a linkage housing portion that defines a cavity located between the first plane and a second plane that is parallel to and spaced away from the first plane, the cavity configured to receive portions of one or more electrical devices therein; and an installation clip cantilevered from the electrical outlet assembly, a free end of the installation clip being moveable with respect to the electrical outlet assembly, the installation clip being configured to be selectively moved by a user from an extended position to a compressed, spring-loaded position by applying a force against the clip, such that when the force is removed from the clip, the clip resiliently returns to the extended position, the cavity configured to enable the user to access the installation clip in order to move the installation clip between the extended position and the compressed spring-loaded position.

29. The electrical hub of claim 28, wherein the housing is open at a front thereof for accessing the cavity, such that the cavity is configured to enable the user to move the installation clip between the extended position and the spring-loaded compressed position.

30. The electrical hub of claim 29, wherein the housing is open at a bottom thereof for accessing the cavity, such that the cavity is configured to enable the user to move the installation clip between the extended position and the spring-loaded compressed position.

31. The electrical hub of claim 28, further comprising a securement panel extending in the second plane from the linkage housing portion.

* * * * *